US008939477B2

(12) United States Patent
Welsby et al.

(10) Patent No.: US 8,939,477 B2
(45) Date of Patent: Jan. 27, 2015

(54) CLUTCH MECHANISM FOR A LOCK ASSEMBLY

(75) Inventors: Scott D. Welsby, Colorado Springs, CO (US); Subashchandra G. Rai, Bangalore (IN)

(73) Assignee: Schlage Lock Company, Carmel, IN (US)

( * ) Notice: Subject to any disclaimer, the term of this patent is extended or adjusted under 35 U.S.C. 154(b) by 558 days.

(21) Appl. No.: 13/092,293

(22) Filed: Apr. 22, 2011

(65) Prior Publication Data

US 2012/0267903 A1 Oct. 25, 2012

(51) Int. Cl.

| | |
|---|---|
| ***E05B 1/00*** | (2006.01) |
| ***E05B 55/00*** | (2006.01) |
| ***E05B 13/10*** | (2006.01) |
| *E05B 3/00* | (2006.01) |

(52) U.S. Cl.

CPC ..... *E05B 55/005* (2013.01); *E05B 13/101* (2013.01)

USPC ..... 292/347; 292/348; 70/224

(58) Field of Classification Search

USPC ..... 292/347, 348; 70/224

See application file for complete search history.

(56) References Cited

U.S. PATENT DOCUMENTS

| | | | | | |
|---|---|---|---|---|---|
| 1,691,528 | A | * | 11/1928 | Schlage | 292/169.16 |
| 2,294,213 | A | * | 8/1942 | Schlage | 292/347 |
| 2,636,376 | A | * | 4/1953 | McConnell | 70/151 R |
| 2,842,952 | A | * | 7/1958 | Russell | 70/216 |
| 3,773,370 | A | | 11/1973 | Jerila | |
| 3,853,341 | A | | 12/1974 | MacDonald | |
| 3,955,387 | A | * | 5/1976 | Best et al. | 70/224 |
| 4,201,069 | A | | 5/1980 | Katayama et al. | |
| 4,428,212 | A | * | 1/1984 | Best et al. | 70/224 |
| 4,921,289 | A | | 5/1990 | Shen | |
| 5,020,343 | A | * | 6/1991 | Hart et al. | 70/143 |
| 5,372,025 | A | | 12/1994 | Lin | |
| 5,457,975 | A | | 10/1995 | Berger et al. | |
| 5,598,726 | A | | 2/1997 | Cordle | |
| 5,761,936 | A | * | 6/1998 | Katayama | 70/224 |
| 5,787,744 | A | | 8/1998 | Berger et al. | |
| 5,904,232 | A | * | 5/1999 | Shen | 192/69.62 |
| 5,934,117 | A | * | 8/1999 | Shen | 70/224 |
| 5,941,108 | A | * | 8/1999 | Shen | 70/467 |

(Continued)

FOREIGN PATENT DOCUMENTS

KR 20-0452607 3/2011

OTHER PUBLICATIONS

PCT/US2012/034493 International Search Report and Written Opinion, date of mailing Nov. 23, 2012, (13 pages).

*Primary Examiner* — Carlos Lugo

(74) *Attorney, Agent, or Firm* — Michael Best & Friedrich LLP

(57) ABSTRACT

A lock assembly that has a locked state and an unlocked state. The lock assembly includes a latch assembly that has a latch and a clutch mechanism. The clutch mechanism includes a first retractor that is movable in response to movement of an interior handle assembly and selectively in response to movement of the exterior handle assembly, and a second retractor that is movable in response to movement of the interior handle assembly and the exterior handle assembly. The first retractor is always engaged with the latch assembly to move the latch between the extended position and the retracted position. The second retractor is selectively disengaged from the latch assembly and is movable relative to the first retractor when the lock assembly is in the locked state.

29 Claims, 24 Drawing Sheets

(56) References Cited

U.S. PATENT DOCUMENTS

| | | | | |
|---|---|---|---|---|
| 6,085,561 | A * | 7/2000 | Yao | 70/472 |
| 6,105,407 | A * | 8/2000 | Yao | 70/472 |
| 6,223,567 | B1 | 5/2001 | Fadul | |
| 6,357,270 | B1 | 3/2002 | Vazquez | |
| 6,497,126 | B2 | 12/2002 | Wang | |
| 6,540,274 | B2 | 4/2003 | Bates et al. | |
| 6,575,006 | B1 * | 6/2003 | Don | 70/472 |
| 6,615,630 | B2 | 9/2003 | Wu et al. | |
| 6,705,138 | B1 | 3/2004 | Shen | |
| 6,745,602 | B2 * | 6/2004 | Nakasone et al. | 70/224 |
| 6,802,194 | B1 | 10/2004 | Shen | |
| 6,845,642 | B2 | 1/2005 | Imedio | |
| 6,929,290 | B2 * | 8/2005 | Don | 292/169 |
| 6,935,148 | B2 * | 8/2005 | Don | 70/472 |
| 7,063,363 | B2 | 6/2006 | Fishencord | |
| 7,100,407 | B2 | 9/2006 | Chen | |
| 7,334,439 | B2 * | 2/2008 | Ruan | 70/224 |
| 7,934,754 | B2 * | 5/2011 | Mathachan | 292/347 |
| 8,256,253 | B2 * | 9/2012 | Chen et al. | 70/224 |
| 8,360,489 | B2 * | 1/2013 | Cho | 292/357 |
| 2002/0104345 | A1 * | 8/2002 | Wang | 70/472 |
| 2003/0150248 | A1 * | 8/2003 | Wu et al. | 70/224 |
| 2004/0144143 | A1 * | 7/2004 | Don | 70/472 |
| 2004/0201225 | A1 | 10/2004 | Kim | |
| 2004/0239123 | A1 | 12/2004 | Kim | |
| 2006/0101879 | A1 | 5/2006 | Velicanin | |
| 2006/0196239 | A1 * | 9/2006 | Shen et al. | 70/224 |
| 2007/0182169 | A1 | 8/2007 | Fang et al. | |
| 2008/0216528 | A1 * | 9/2008 | Sun et al. | 70/224 |
| 2010/0257906 | A1 | 10/2010 | Sorensen et al. | |

* cited by examiner

CLUTCH MECHANISM FOR A LOCK ASSEMBLY

BACKGROUND

The invention relates to a lock assembly. More particularly, the invention relates to a lock assembly that includes a retractor mechanism used to extend and retract a latch of the lock assembly.

Conventional lock assemblies generally include an outer handle and an inner handle respectively attached to the outside and the inside of a door or other structure so that a latch or bolt can be retracted by turning either one of the outer handle and the inner handle. Some lock assemblies generally include a retractor mechanism that is attached to the outer and inner handles and the latch for moving the latch between extended and retracted positions. When the lock assembly is in a locked state, the outer handle generally cannot be turned for retracting the latch. When a user applies force to the outer handle in the locked state to an extent that is normally sufficiently large enough for retracting the latch, the lock assembly components connected to the handle can be damaged due to a torque resulting from to the force applied to the outer handle.

SUMMARY

In some constructions, the invention provides a lock assembly that has a locked state and an unlocked state. The lock assembly includes a latch assembly that has a latch movable between an extended position and a retracted position, an interior handle assembly, an exterior handle assembly, and a clutch mechanism. The interior handle assembly is coupled to the latch assembly and includes an interior handle, and the exterior handle assembly is coupled to the latch assembly opposite the interior handle assembly and includes an exterior handle. The clutch mechanism includes a first retractor that is movable in response to movement of the interior handle and selectively in response to movement of the exterior handle, and a second retractor that is movable in response to movement of the interior handle assembly and the exterior handle assembly. The first retractor is always engaged with the latch assembly to move the latch between the extended position and the retracted position. The second retractor is selectively disengaged from the latch assembly and is movable relative to the first retractor when the lock assembly is in the locked state.

In other constructions, the invention provides a lock assembly that has a locked state and an unlocked state. The lock assembly includes a latch assembly that has a latch movable between an extended position and a retracted position. The lock assembly also includes an interior handle assembly that is coupled to the latch assembly and that has an interior handle, and an exterior handle assembly that is coupled to the latch assembly opposite the interior handle assembly and that has an exterior handle. The lock assembly further includes a clutch mechanism that has a retractor mechanism coupled to the latch assembly to move the latch between the extended position and the retracted position. The retractor mechanism includes a first retractor and a second retractor that are movable in response to movement of the interior handle. The second retractor also is selectively movable relative to the first retractor in response to movement of the exterior handle. The lock assembly also includes an engagement mechanism that is coupled to the interior handle assembly and the exterior handle assembly. The engagement mechanism is further coupled to the retractor mechanism and is selectively operable to engage and disengage the second retractor relative to the latch. The engagement mechanism is partially defined by an actuator assembly that is movable in a first direction to disengage the second retractor relative to the latch such that rotation of the exterior handle does not move the latch to the refracted state, and that is movable in a second direction to engage the second retractor relative to the latch such that rotation of the exterior handle is operable to move the latch to the refracted state.

Other constructions of the invention provide a lock assembly that has a locked state and an unlocked state. The lock assembly includes a latch assembly that has a latch movable between an extended position and a retracted position, an interior handle assembly, an exterior handle assembly, a clutch mechanism, and a free spinning mechanism engageable with the clutch mechanism. The clutch mechanism is engaged with the latch to move the latch between the extended position and the retracted position. The free spinning mechanism is engageable with the clutch mechanism and is partially defined by an alignment mechanism that is coupled to the exterior handle to maintain alignment of the exterior handle relative to other components of the lock assembly during rotation of the exterior handle. In response to rotation of the exterior handle when the lock assembly is in the unlocked state, the clutch mechanism is operable by the exterior handle to move the latch from the extended position to the retracted position. In response to rotation of the exterior handle when the lock assembly is in the locked state, the latch remains in the extended position and the exterior handle is free to rotate 360 degrees.

Still other constructions of the invention provide a lock assembly that has a locked state and an unlocked state. The lock assembly includes a latch assembly that has a latch movable between an extended position and a retracted position, an interior handle assembly, an exterior handle assembly, and a clutch mechanism. The clutch mechanism includes a first retractor that is engaged with the latch to move the latch between the extended position and the retracted position, and a second retractor that is removably coupled to the first retractor such that the second retractor is selectively engaged with the latch. The lock assembly also includes a free spinning mechanism that is coupled to the exterior handle and engageable with the clutch mechanism such that in response to rotation of the exterior handle when the lock assembly is in the unlocked state, the clutch mechanism is operable by the exterior handle to move the latch from the extended position to the retracted position. In response to rotation of the exterior handle when the lock assembly is in the locked state, the latch remains in the extended position and the exterior handle is free to rotate 360 degrees.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
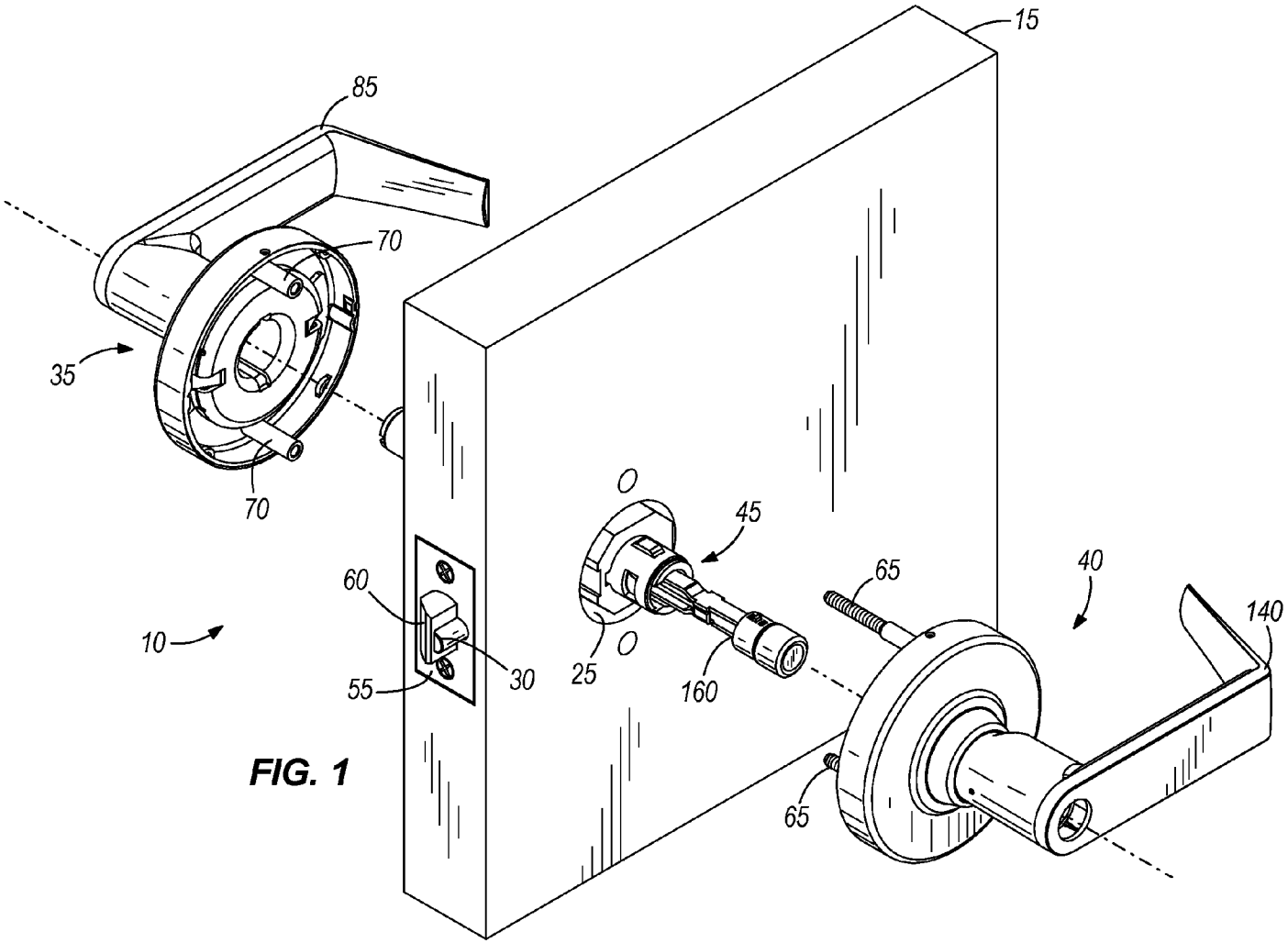
FIG. 1 is a partially exploded perspective view of a door and a lock assembly embodying the invention.

FIG. 1 shows a lock assembly 10 for use with a structure 15 (e.g., door, access panel, portable locks, etc.) that may be locked and unlocked. Hereinafter, the term "door" shall be used to represent all such lockable structures and shall not be construed to limit the invention's application solely to doors. The lock assembly 10 illustrated in FIG. 1 can be varied between a locked state and an unlocked state using an appropriate key 20.

FIGS. 1-7 show that the lock assembly 10 is disposed in an opening 25 in the door 15, and includes a latch assembly 30, an exterior handle assembly 35, an interior handle assembly 40, and a chassis assembly 45 positioned between the exterior and interior handle assemblies 35, 40 and coupled to the latch assembly 30. The latch assembly 30 is located between the exterior handle assembly 35 and the interior handle assembly 40 in a bore (not shown) of the door 15. The latch assembly 30 includes a body 50 defining a latch plate 55, and a latch 60 that is movable between an extended position and a refracted position relative to the latch plate 55 such that when the latch 60 is in the extended position, the latch 60 engages a pocket (e.g., strike plate—not shown) in a frame (not shown) of the door 15 to hold the door 15 in a closed position. The latch 60 is movable to the retracted position to allow the door 15 to move to an open position. Such latch assembly arrangements are well known in the art.

The exterior handle assembly 35 and the interior handle assembly 40 encapsulate or enclose the chassis assembly 45 within the door 15 and are attached to each other and to the door 15 by fasteners 65 and fastener attachment portions 70. The illustrated fasteners 65 are coupled to the interior handle assembly 40 and the fastener attachment portions 70 are coupled to the exterior handle assembly 35. In other constructions, the fasteners 65 can be located on one or both the exterior handle assembly 35 and the interior handle assembly 40, with the fastener attachment portions 70 on the complementary portion of the other handle assembly to which the fasteners 65 are not coupled.

FIGS. 1-5 show that the exterior handle assembly 35 includes a first rose or trim piece 75, a first cover plate 80, an exterior handle 85 (e.g., lever), and a lock cylinder 90. The first trim piece 75 is coupled to an exterior surface of the door 15 and cooperates with the first cover plate 80 to limit access to the interior portion of the lock assembly 10 when the lock assembly 10 is attached to the door 15.

As illustrated in FIGS. 1-7, the exterior handle 85 is coupled to and extends outward from the first trim piece 75. The exterior handle 85 includes a housing portion 95, a spring cage 100, spindle slots 102, and a grip portion 105 that extends laterally outward from the housing portion 95. The housing portion 95 defines a central cavity 110 that is accessible from an end of the exterior handle 85 adjacent the first trim piece 75. The grip portion 105 is engageable by a user to rotate the exterior handle 85. Although the illustrated exterior handle 85 is a lever handle, other types of handles are possible and considered herein.

Figure 5:
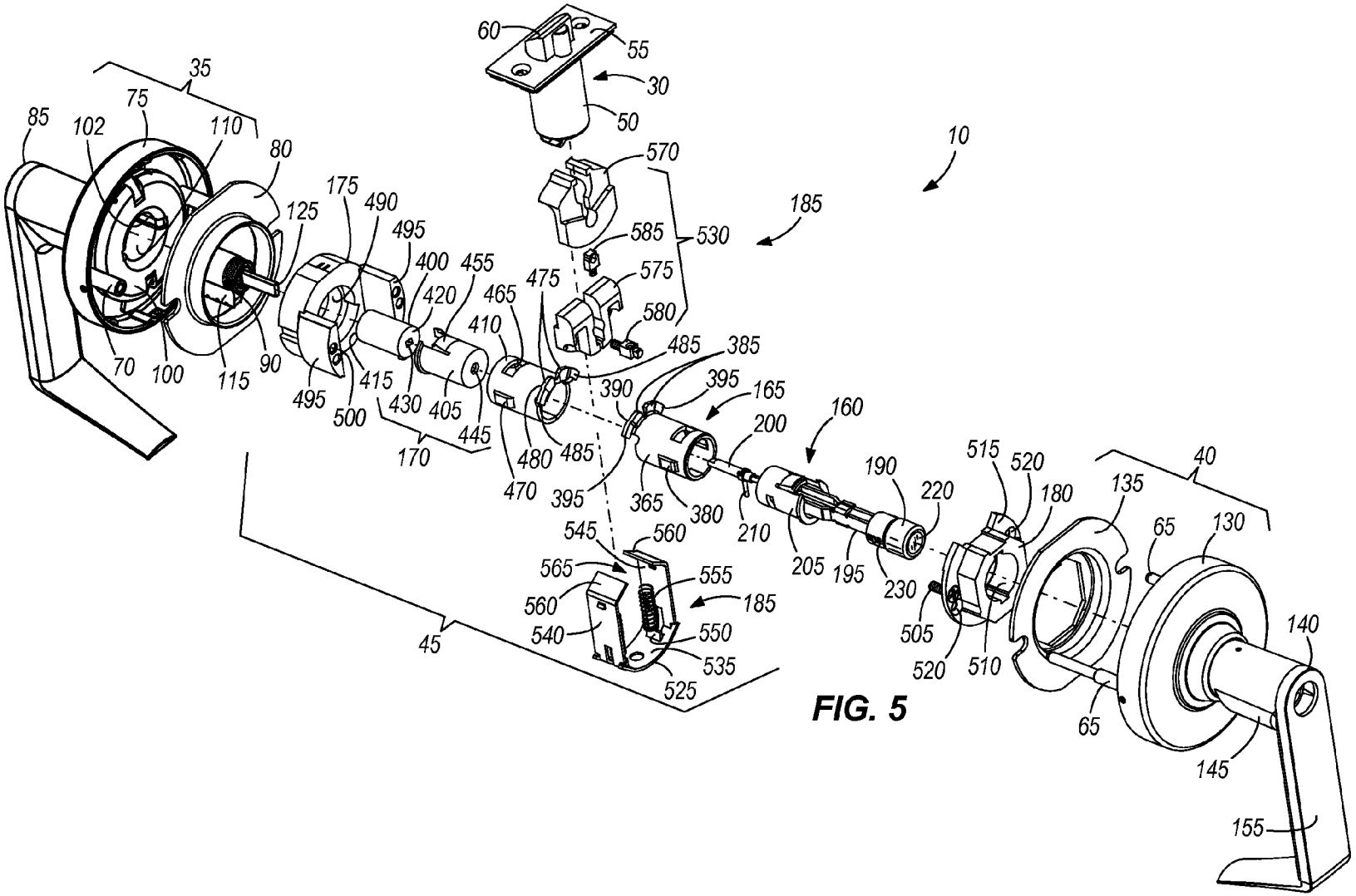
FIG. 5 is an exploded perspective view of the lock assembly of FIG. 2.
Figure 6:
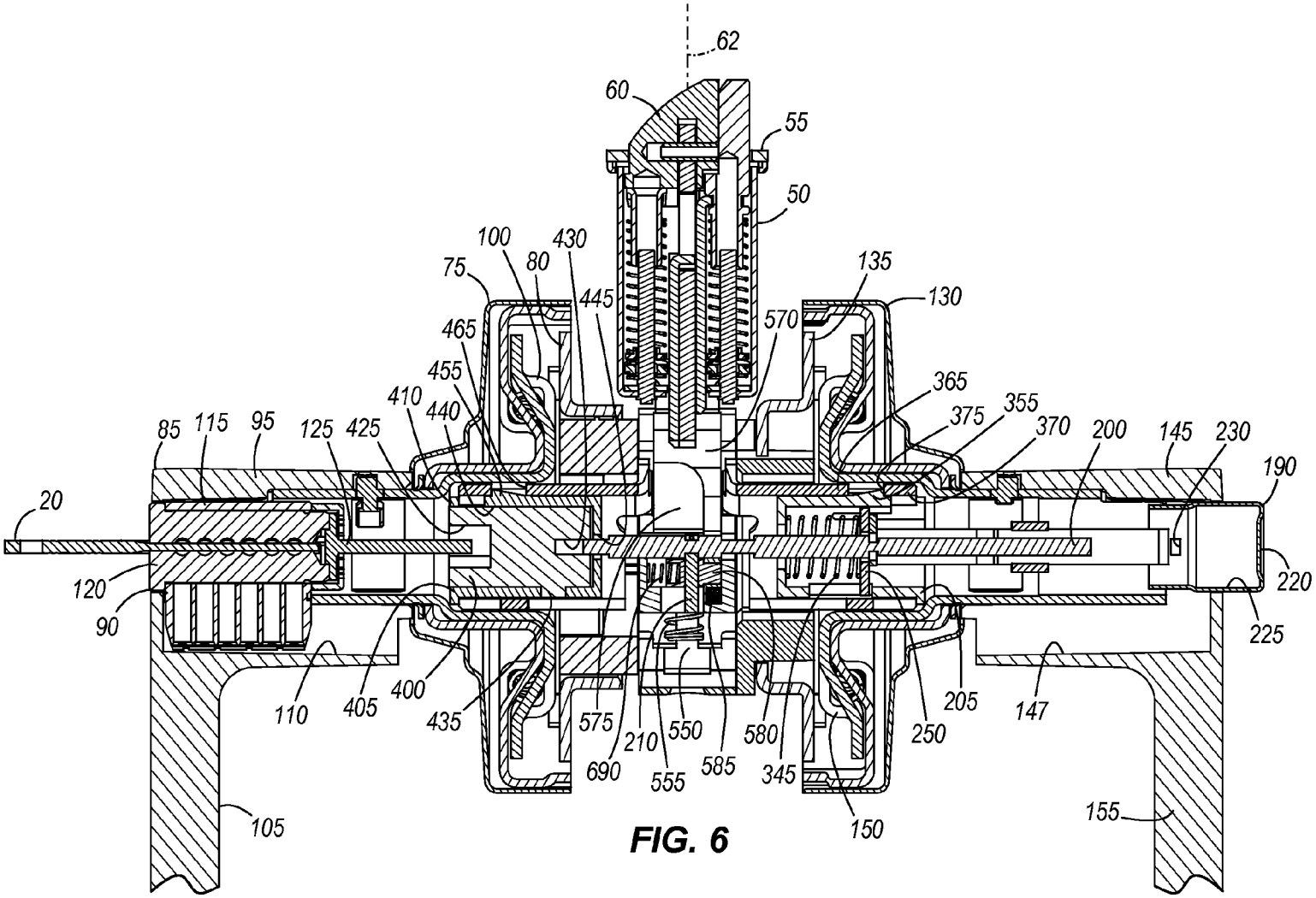
FIG. 6 is a section view taken along line 6-6 of the lock assembly of FIG. 2 illustrating the lock assembly in an unlocked state.
Figure 7:
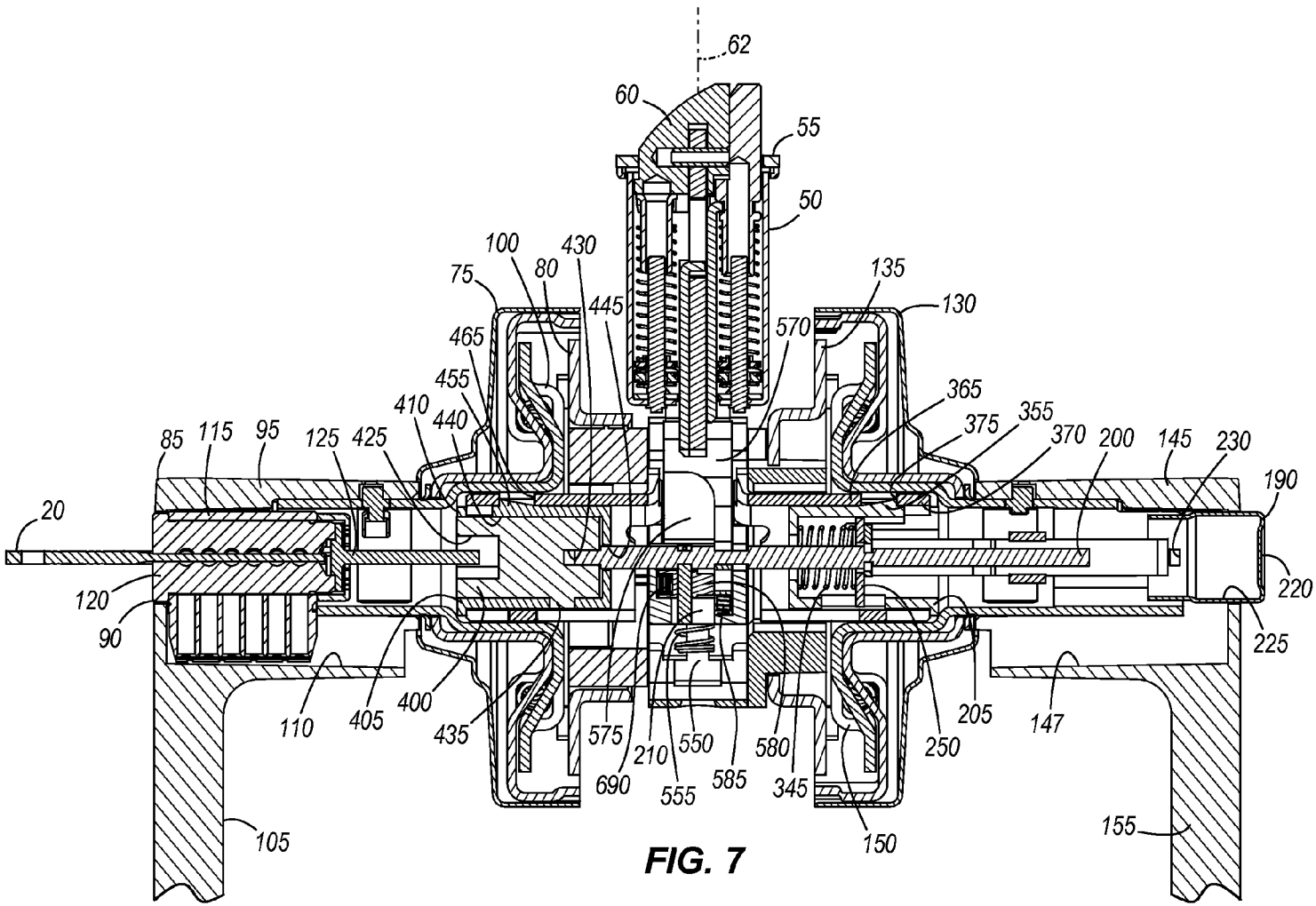
FIG. 7 is a section view taken along line 7-7 of the lock assembly of FIG. 3 illustrating the lock assembly in a locked state.

As shown in FIGS. 5-7, the lock cylinder 90 is disposed in the cavity 110 and is rotatable with the exterior handle 85. FIGS. 6 and 7 show that the lock cylinder 90 includes a housing 115, a plug 120 that is selectively rotatable within the housing 115 using the key 20, and a driver bar or tailpiece 125. The housing 115 cooperates with the plug 120 to define a pin-tumbler lock cylinder arrangement that has inner and outer pins (none shown for clarity) engageable by an appropriate key 20. The plug 120 is movable or rotatable relative to the housing 115 between a locked position and an unlocked position, and the tailpiece 125 is coupled to an end of the plug 120 and is rotatable with the plug 120. Such arrangements are well known in the art. The tailpiece 125 extends from the plug 120 inward toward the chassis assembly 45.

FIGS. 1-7 show that the interior handle assembly 40 includes a second rose or trim piece 130, a second cover plate 135, and an interior handle 140 (e.g., lever). The second trim piece 130 is coupled to an exterior surface of the door 15 that is opposite the exterior surface to which the first trim piece 75 is attached. The second trim piece 130 cooperates with the second cover plate 135 to limit access to the interior portion of the lock assembly 10 when the lock assembly 10 is attached to the door 15.

The interior handle 140 is coupled to and extends outward from the second trim piece 130, and includes a housing portion 145, a spring cage 150, and a grip portion 155. The housing portion 145 defines a cavity 147 that extends completely through the housing portion 145. The grip portion 155 extends laterally outward from the housing portion 145, and is engageable by a user to rotate the interior handle 140. Although the illustrated interior handle 140 is a lever handle, other types of handles are possible and considered herein.

FIGS. 1, 2, and 4-10 show that the chassis assembly 45 includes an actuator or pushbutton assembly 160, a first or interior driver mechanism 165, a second or exterior driver mechanism 170, an exterior hub 175, an interior hub 180, and a clutch mechanism 185. The chassis assembly 45 is coupled to and drivingly engaged with the latch assembly 30, the exterior handle assembly 35, and the interior handle assembly 40 to move the latch 60 between the extended position and the retracted position.

FIGS. 5-7, 9-14, and 16 illustrate one construction of the pushbutton assembly 160 that is coupled to the interior handle assembly 40 and partially disposed in the second trim piece 130 and the housing portion 145. The pushbutton assembly 160 includes a pushbutton 190, a connector 195, a pushbutton bar 200, an interior driver catch 205, and a locking lug actuator 210. The pushbutton 190 is substantially cylindrical and is defined by a pushbutton interface 220 that encloses a cavity 225.

The pushbutton 190 also includes apertures 230 located adjacent the opening to the cavity 225. The apertures 230 extend through the pushbutton 190 and are in communication with the cavity 225 to attach the connector 195 to the pushbutton 190. The pushbutton 190 illustrated in FIGS. 9 and 12 includes two sets of apertures 230 located opposite each other (i.e., the sets of apertures 230 are spaced 180 degrees circumferentially around the pushbutton 190). Each set includes three square-shaped apertures 230 to accommodate different desired lengths for the pushbutton assembly 160. Other pushbuttons may include fewer or more than three apertures 230 that have square or other shapes (e.g., circular, triangular, rectangular, etc.) to attach the pushbutton 190 to the connector 195.

The connector 195 includes a first arm 235 and a second arm 240 spaced apart from the first arm 235. Each of the first arm 235 and the second arm 240 includes a pushbutton tab 245 that is located adjacent an end of the connector 195 and that is engageable with the pushbutton 190 within one of the apertures 230 to rigidly attach the pushbutton 190 to the connector 195. The second arm 240 is connected to the first arm 235 by a connector plate 250 located adjacent the end of the connector 195 that is opposite the end connected to the pushbutton 190. The connector plate 250 also includes a hole 255 to accommodate the pushbutton bar 200, and opposed spacer plates 260 that define a minimum distance between the first and second arms 235, 240.

Figures 9, 10:
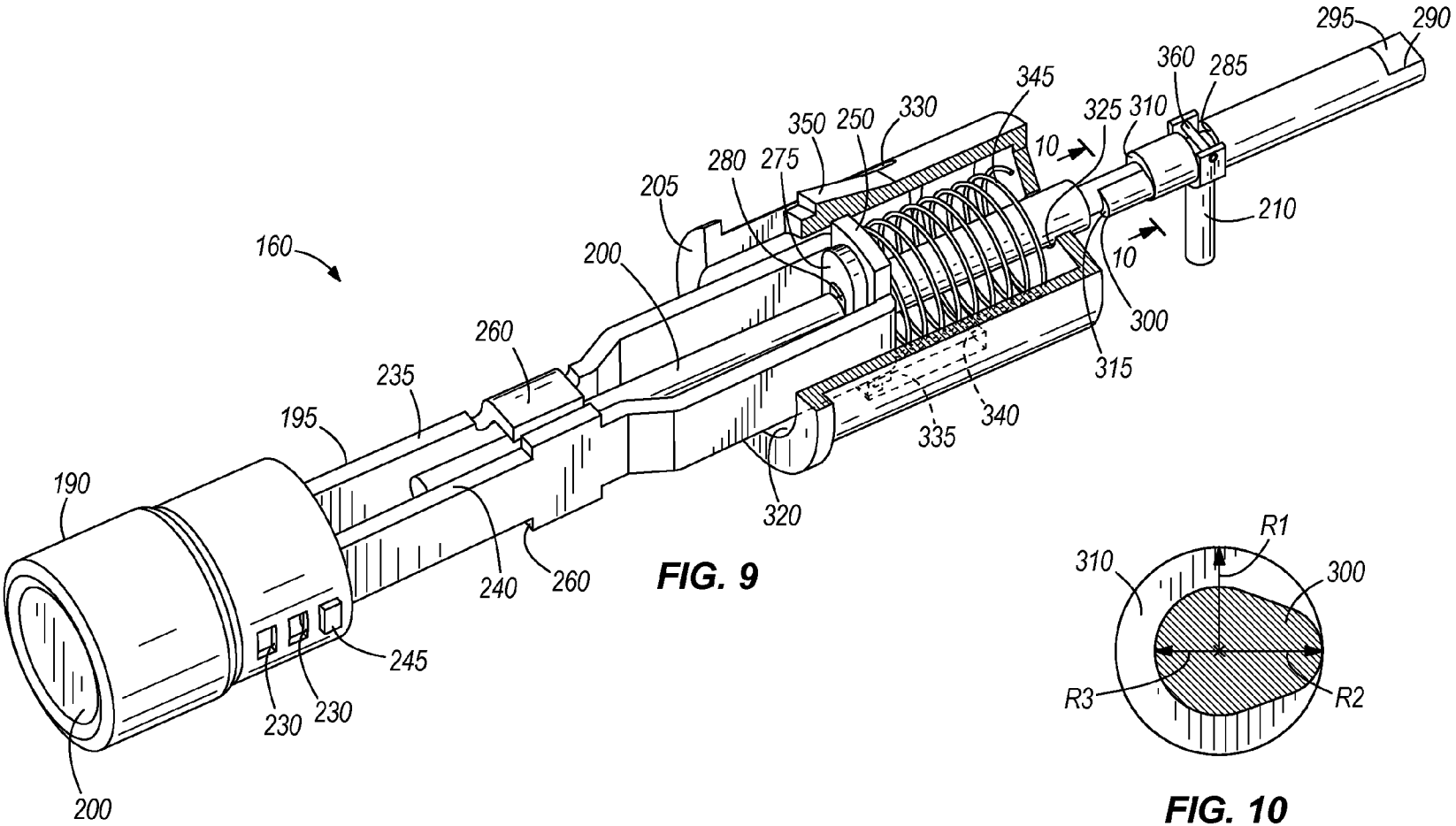
FIG. 9 is a perspective view of a portion of the pushbutton assembly of FIG. 5 including a pushbutton, a pushbutton driver, a locking lug, and an interior spindle.
FIG. 10 is a section view taken along 10-10 of the pushbutton driver of FIG. 8 and including a cam.

With continued reference to FIGS. 6, 7, and 9, the pushbutton bar 200 is defined by an elongated shaft that is coupled to the pushbutton 190 via the connector 195. The pushbutton bar 200 is further defined by a connector portion and an actuator portion. The connector portion of the pushbutton bar 200 is coupled to the connector 195 using a clip 275 that engages a clip channel 280 radially recessed within the pushbutton bar 200. The clip 275 and the connector plate 250 cooperate to minimize movement of the pushbutton bar 200 relative to the connector 195.

The actuator portion 275 extends from the connector 195 and includes a lug attachment channel 285, a driver engagement member 290 adjacent an end of the pushbutton bar 200, and a cam member 300. The lug attachment channel 285 is recessed radially inward and extends circumferentially around the pushbutton bar 200 to accommodate attachment of the locking lug actuator 210 to the pushbutton bar 200. As illustrated, the driver engagement member 290 has a chamfered cylindrical shape that defines diametrically opposed planar surfaces 295 (i.e., the driver engagement member 290 is defined by a double flat-faced cylindrical geometry).

FIGS. 6, 7, and 9 show that the cam member 300 is located on the pushbutton bar 200 inward from the lug attachment channel 285 relative to the end of the pushbutton bar 200 that is adjacent the driver engagement member 290. As illustrated in FIG. 10, the portion of the pushbutton bar 200 nearest the cam member 300 has a first radius R1. The cam member 300 defines a cam surface 305 and has an oblong profile such that the outermost portion of the cam member 300 has a second radius R2 that is the same, or substantially the same, as the first radius R1. The portion of the cam member 300 opposite the oblong profile has a third radius R3 that is smaller than the radius of the portion of the pushbutton bar 200 that is nearest the cam member 300. The first and third radii R2 and R3 of the portion of the pushbutton bar 200 and the cam member 300 define a transition or step 310. With reference to FIGS. 9 and 10, a catch channel 315 is disposed in the pushbutton bar 200 between the cam member 300 and the connector plate 250 to accommodate a portion of the clutch mechanism 185.

FIGS. 5-7 and 9 show the interior driver catch 205 that is defined by a hollow cylindrical body that has an access opening 320, and a hole 325 opposite the opening 320 to accommodate the pushbutton bar 200. The connector 195 is partially disposed in the interior driver catch 205, and the connector plate 250 is coupled to the interior driver catch 205 within an elongated slot 330 to accommodate movement of the pushbutton mechanism. The slot 330 has a first slot portion 335 that extends longitudinally along a portion of the cylindrical body, and a second slot portion 340 that extends circumferentially or radially around the cylindrical body such that the second slot portion 340 is oriented perpendicular to the first slot portion 335.

A bias member 345 (e.g., spring) is disposed in the hollow portion of the interior driver catch 205 such that when the pushbutton bar 200 assembly is assembled, the bias member 345 is sandwiched between the connector plate 250 and the interior driver catch 205 to bias the pushbutton 190 outward (i.e., toward the left in FIG. 9). The interior driver catch 205 also includes a tab member 350 (partially shown in FIG. 9) that is biased outward from the interior driver catch 205.

FIGS. 5 and 9 show that the locking lug actuator 210 is defined by an elongated member and is coupled to the pushbutton bar 200 within the lug attachment channel 285 by a spring pin 360 such that the locking lug actuator 210 can rotate around the pushbutton bar 200 by virtue of the spring pin connection. The locking lug actuator 210 is engageable with other portions of the chassis assembly 45 and assists with varying the lock assembly 10 between the unlocked state and the locked state. The illustrated locking lug actuator 210 is defined by a substantially cylindrical shaft, although other shapes are also possible and considered herein.

FIGS. 1, 4-7, 11-14, 16, 17A, and 17B show that the interior driver mechanism 165 includes an interior spindle 365 that is defined by a cylindrical body that has a wall 370. The interior spindle 365 has an aperture 375 extending through the wall 370, and the interior driver catch 205 is disposed within the interior spindle 365 such that the tab member 350 is engaged with the wall 370 within the aperture 375. In this manner, the interior spindle 365 encapsulates and is rotatable with the interior driver catch 205.

The interior spindle 365 also includes diametrically opposed protrusions 380 extending outward from the wall 370, and a first flange 385 extending radially outward from an end of the wall 370. The protrusions 380 are located along the outside of the wall 370 to engage corresponding recesses (not shown) within the interior handle assembly 40. The first flange 385 has a curved outer surface 390 and radially projecting retractor engagement portions 395 adjacent lateral ends of the first flange 385.

FIGS. 5-7, 11-13, 15, 16, 17B, 18A, and 18B show that the exterior driver mechanism 170 includes a driver 400, an exterior driver catch 405, and an exterior spindle 410. The driver 400 is defined by a cylindrical body and includes a first end 415 and a second end 420 that is opposite the first end 415. The first end 415 has a first recess 425 extending partially through the driver 400 toward the second end 420. The second end 420 has a second recess 430 extending partially through the driver 400 toward the first end 415. As shown in FIGS. 5-7, the driver 400 further includes a protrusion 435 extending outward from the cylindrical body adjacent the second end 420.

Figure 15:
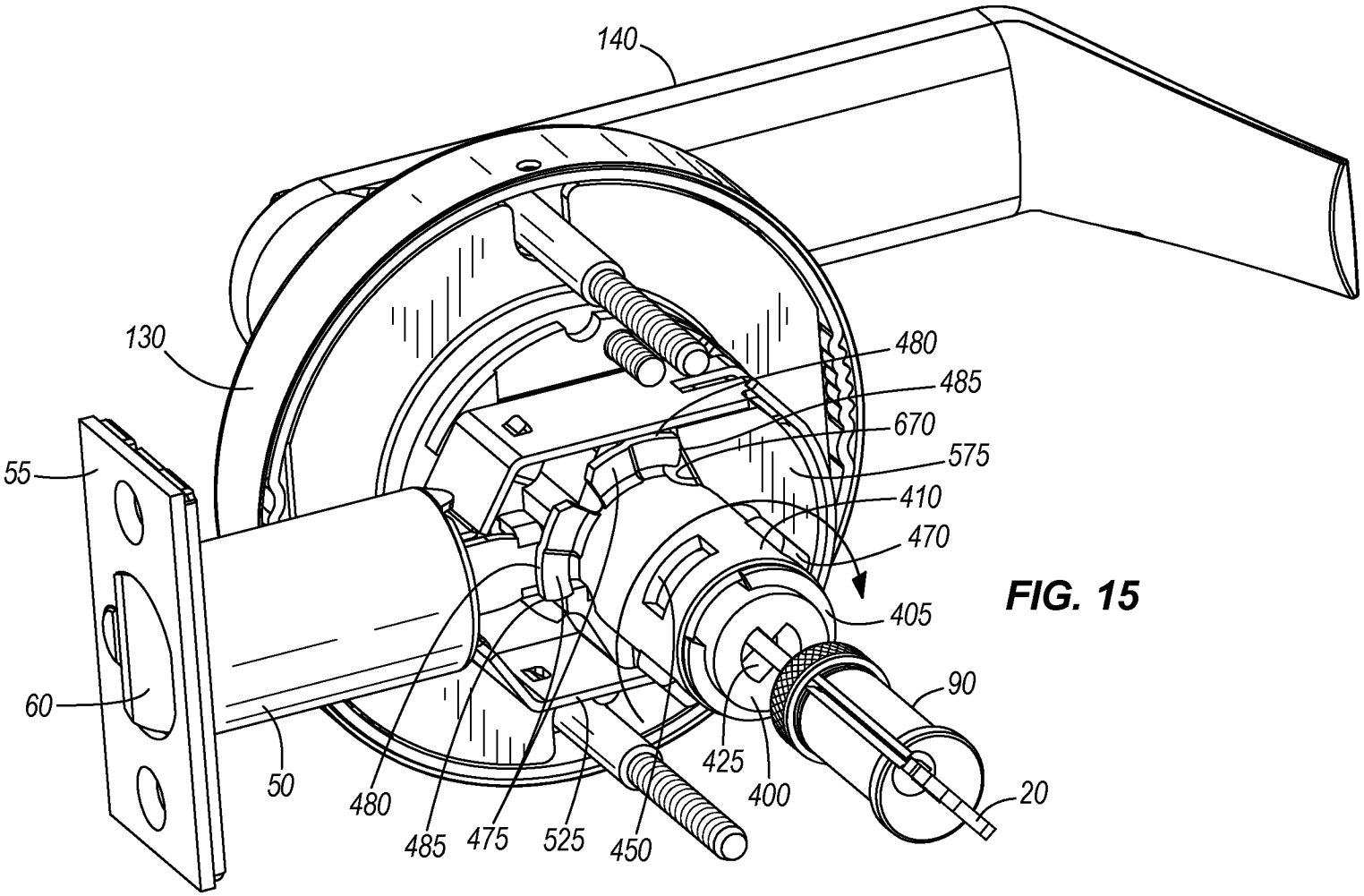
FIG. 15 is a perspective view of a portion of the lock assembly including the interior handle assembly, the chassis assembly, the latch assembly, a lock cylinder, and an exterior spindle assembly in the unlocked state and the exterior handle assembly rotated from a rest position.
Figure 16:
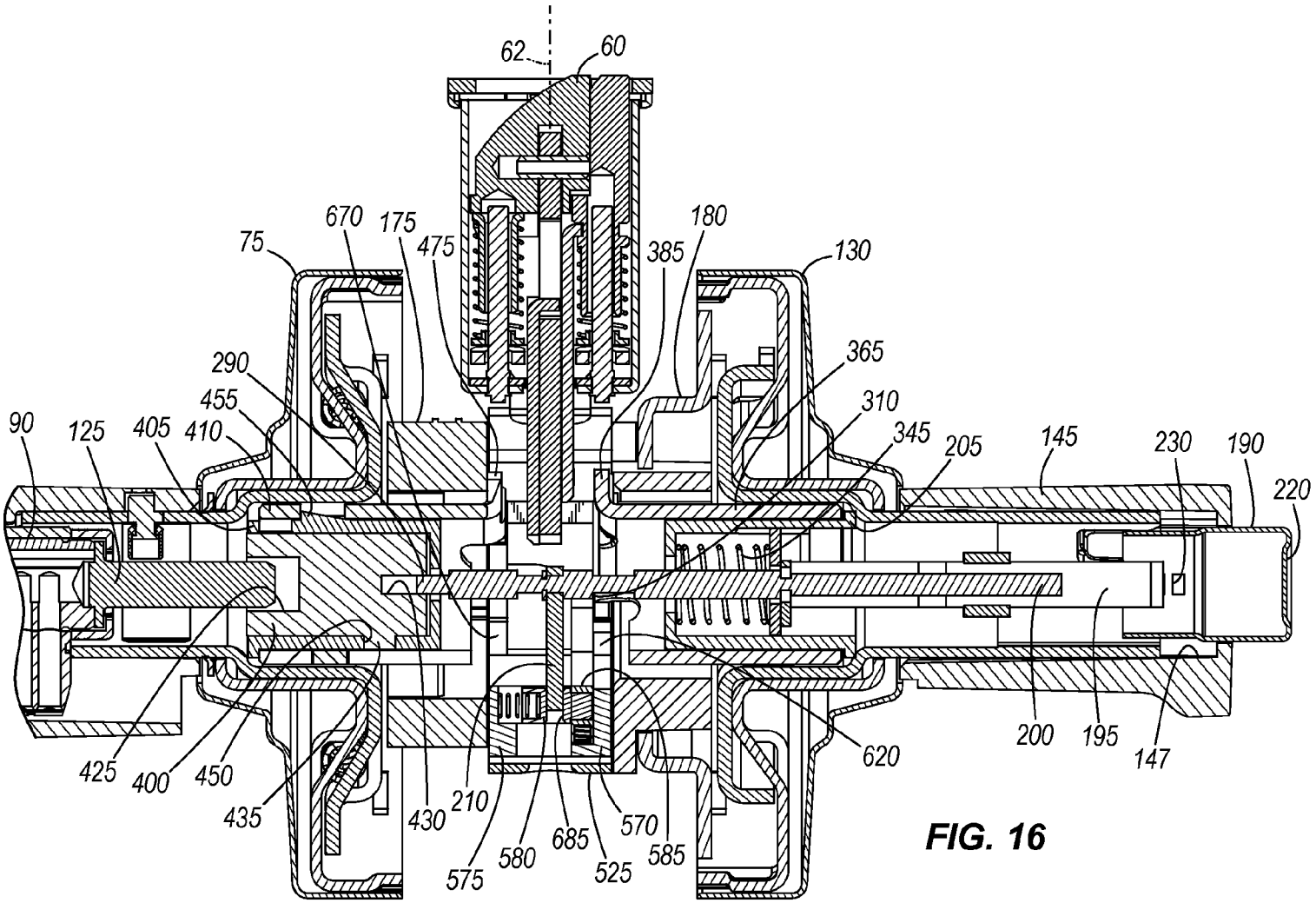
FIG. 16 is a partial section view of the lock assembly taken along line 16-16 of FIG. 2.
Figure 17B:
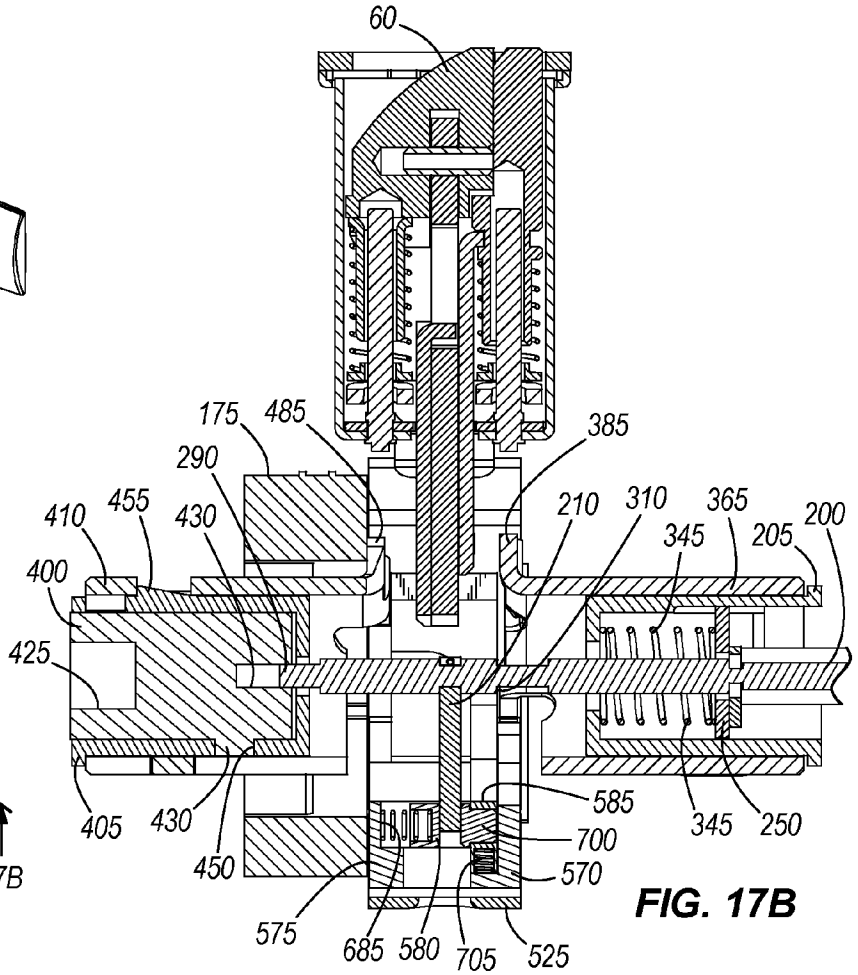
FIG. 17B is a perspective view of the lock assembly taken along line 17B-17B of FIG. 17A.
Figure 17A:
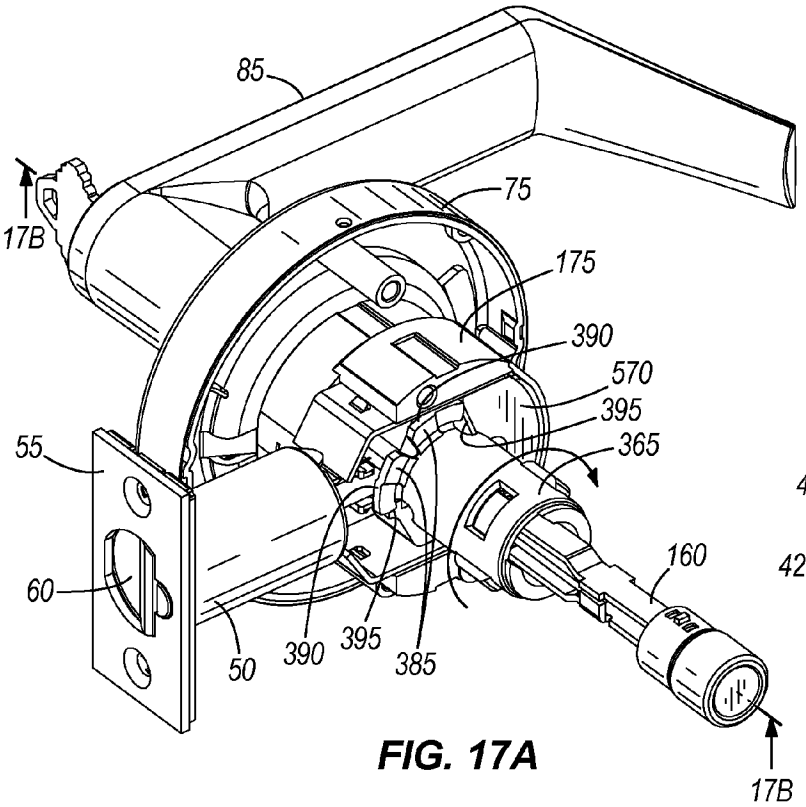
FIG. 17A is a perspective view of a portion of the lock assembly including the exterior handle assembly, the pushbutton assembly, the chassis assembly, and the latch assembly in the locked state and the interior handle assembly in a rotated position.

FIGS. 6, 7, 15, 16, 18A, and 18B show that the first end 415 is in communication with the lock cylinder 90 such that the tailpiece 125 extends into and is engaged with the driver 400 in the first recess 425 to transfer rotation of the plug 120 to the driver 400. As illustrated in FIG. 15, the first recess 425 is shaped to accommodate the tailpiece 125 when the plug 120 is rotated between the locked position and the unlocked position while allowing relative movement of the tailpiece 125 when the plug 120 is rotated from either the locked position or the unlocked position to a neutral position.

FIGS. 5-7, 11-13, 16, 17B, and 18B show that the second end 420 is in communication with the pushbutton bar 200 such that the driver engagement member 290 extends into and is engaged with the driver 400 in the second recess 430 to selectively transfer rotation of the plug 120 to the pushbutton bar 200. The second recess 430 is shaped to conform to the shape of the driver engagement member 290 such that the pushbutton bar 200 is slidable into and out of engagement with the driver 400.

Figure 20:
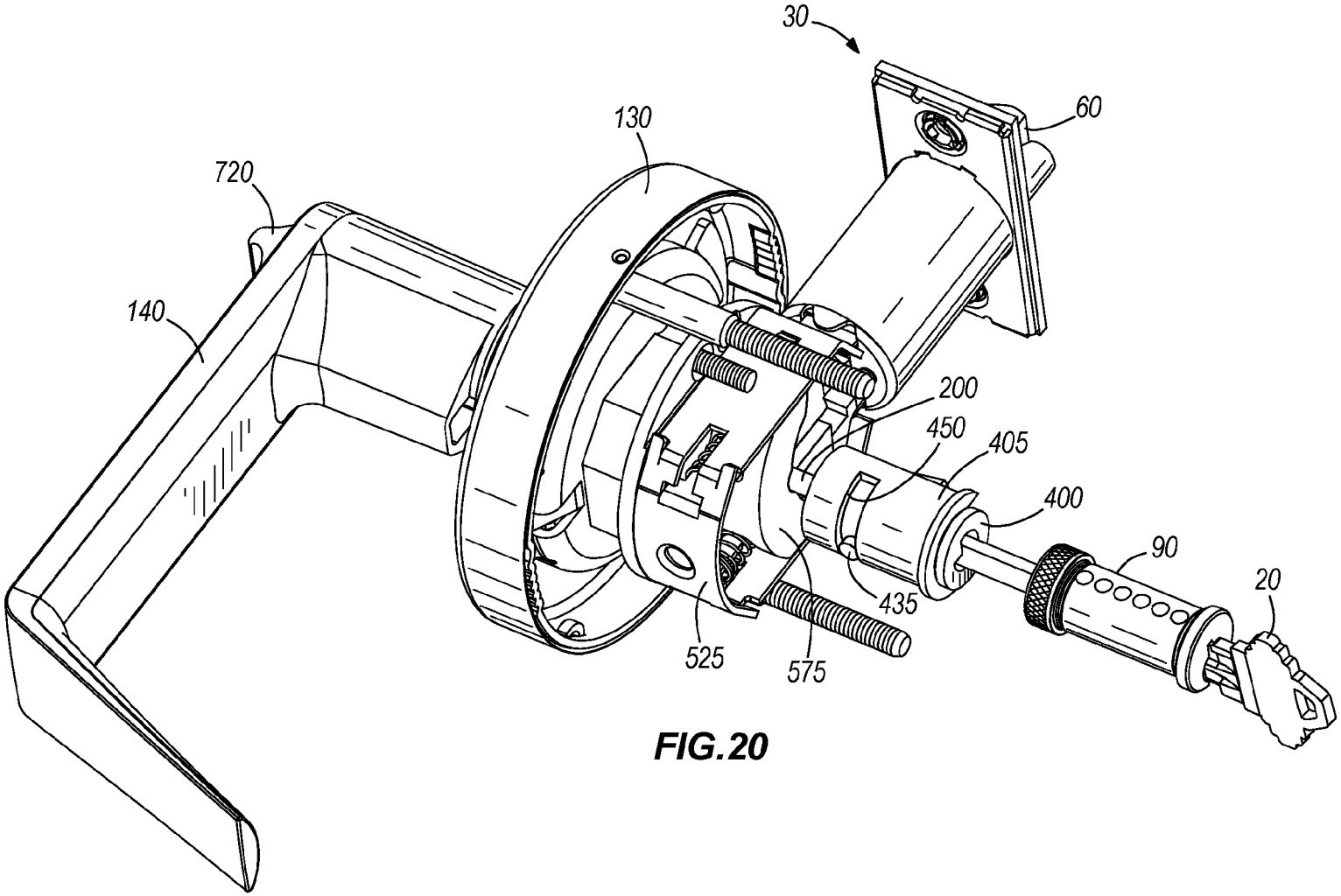
FIG. 20 is a perspective view of a portion of another lock assembly including the push and turn button assembly of FIG. 19 and an exterior spindle assembly.

FIGS. 5-7, 11-13, 16, 17B, and 18B show that the exterior driver catch 405 is defined by a hollow cylindrical body that has an access opening 440 and a hole 445 opposite the access opening 440. The driver 400 is substantially encapsulated by the exterior driver catch 405 within the access opening 440. As shown in FIGS. 6, 7, and 20, the exterior driver catch 405 includes a circumferential slot 450 to retain the driver 400 in the access opening 440 via engagement of the protrusion 475 with the slot 450. The slot 450 further allows the driver 400 to rotate in response to rotation of the pushbutton bar 200 or the driver 400 when the lock assembly 10 is locked or unlocked from inside or outside the area confined by the door 15. With reference back to FIGS. 5-7, 11-13, 16, 17B, and 18B, the exterior driver catch 405 also includes a tab member 455 that is biased outward from the interior driver catch 205.

FIGS. 5-7, 11-13, 15, 16, 17B, 18A, and 18B show that the exterior spindle 410 is disposed in the exterior spindle 410, and is defined by a wall 460. The exterior spindle 410 has an aperture 465 extending through the wall 460, and the tab member 455 is engaged with the wall 460 within the aperture 465. In this manner, the exterior spindle 410 encapsulates and is rotatable with the interior driver catch 205.

The exterior spindle 410 also includes diametrically opposed protrusions 470 that extend outward from the wall 460, and a second flange 475 that extends radially outward from an end of the wall 460. The protrusions 470 are located along the outside of the wall 460 to engage corresponding recesses (not shown) within the exterior handle assembly 35. The second flange 475 has a curved outer surface 480 and radially projecting retractor engagement portions 485 adjacent radial ends of the second flange 475.

FIGS. 1, 4-7, 11-14, and 16 show that the exterior hub 175 and the interior hub 180 encapsulate a portion of the chassis assembly 45 and support the lock assembly 10 in the door 15. The exterior hub 175 is supported within the first cover plate 80, and includes a cylindrical body that defines a cavity 490. The cavity 490 is sized to receive the driver 400, the exterior driver catch 405, and the exterior spindle 410 such that the second flange 475 of the exterior spindle 410 substantially abuts the exterior hub 175.

The exterior hub 175 also includes chassis members 495 that extend outward from the cylindrical body. The chassis members 495 are spaced apart from each other to accommodate the clutch mechanism 185, and the chassis members 495 include fastener holes 500 that extend into the chassis members 495 and that receive fasteners 500 to attach the exterior hub 175 to the interior hub 180.

FIGS. 1, 4-7, 11-13, 15, and 16 show that the interior hub 180 includes a cavity 510 and a fastener plate 515 extending radially outward from an end of the interior hub 180. In the assembled state, the fastener plate 515 abuts the chassis members 495, and the fastener plate 515 includes fastener holes 520 that receive the fasteners 505 for attaching the exterior hub 175 to the interior hub 180.

Figure 8:
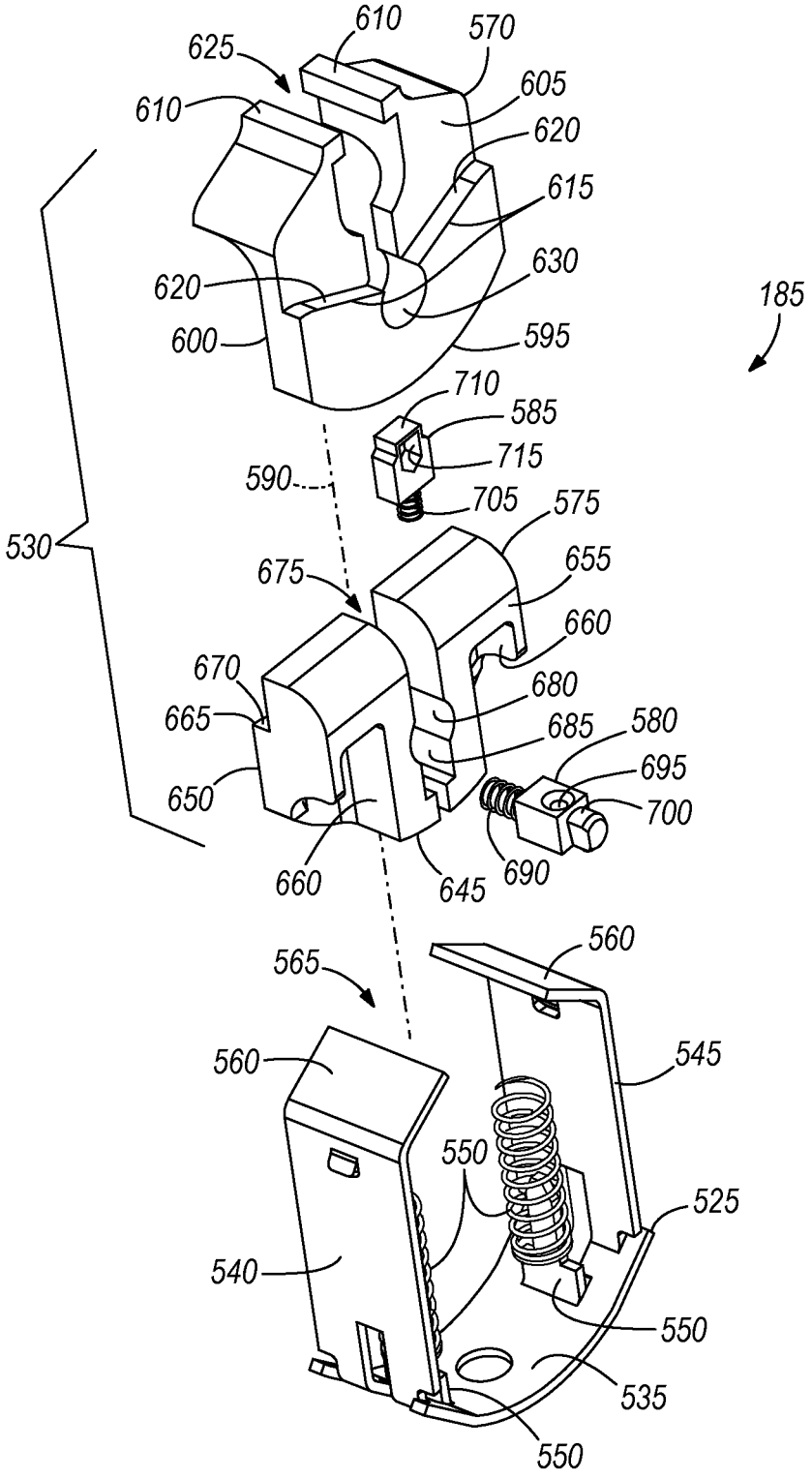
FIG. 8 is an exploded perspective view of a clutch mechanism of FIG. 5 including a retainer apparatus, an interior retractor, an exterior retractor, a locking lug, and a pushbutton catch.

FIGS. 5-8, and 11-18B show that the clutch mechanism 185 is disposed in the space defined between the exterior hub 175 and the interior hub 180. The clutch mechanism 185 includes a spring cage or retainer apparatus 525 that supports a retractor mechanism 530 for selectively retracting the latch 60. As illustrated in FIGS. 5 and 8, the retainer apparatus 525 includes a central portion 535, a first side portion 540, and a second side portion 545. The central portion 535, the first side portion 540, and the second side portion 545 can be formed together or separately using any suitable manufacturing techniques. The central portion 535 is defined by a curvilinear shape that conforms to the curved shape of the exterior hub 175. Posts 550 extend inward from the central portion 535 to support retractor mechanism springs 555.

The first side portion 540 and the second side portion 545 form bearing surfaces for sliding the retractor mechanism 530 in a linear direction between an extended and a retracted position. Each of the first side portion 540 and the second side portion 545 includes a retainer element 560 that constrains the retractor mechanism 530 against the bias of the retractor mechanism springs 555. The retainer elements 560 extend outward from the first side portion 540 and the second side portion 545 and are angled toward each other to form a narrowed gap 565. The width of the gap 565 is designed to constrain the retractor mechanism 530, yet allow extension and retraction of the latch 60.

The retractor mechanism 530 includes an interior retractor 570, an exterior retractor 575, a lock element or locking lug 580, and a pushbutton catch 585 that cooperate with the interior spindle 365 and the exterior spindle 410 to convert rotational movement to translational or lateral movement of the latch 60. As described in detail below and illustrated in FIGS. 5-8 and 11-18B, the interior retractor 570 and the exterior retractor 575 are shaped to mate or align with each other within the retainer apparatus 525, and are selectively drivingly coupled to each other via engagement of the locking lug 580 with the pushbutton catch 585 to permit translational movement of the exterior retractor 575 relative to the interior retractor 570.

FIGS. 5 and 8 shows that the interior retractor 570 is defined by an interior retractor 570 body that is symmetrical about a plane extending through the interior retractor 570 along an axis 590. FIGS. 5-7, 10-12, and 15 show that the interior retractor 570 includes a base 595 adjacent one end of the interior retractor 570, a first side 600, a second side 605 opposite the first side 600, and opposed latch engagement portions 610 extending outward (upward in FIGS. 5 and 8) from the base 595. The base 595 is defined by a curvature that conforms to the curvature of the central portion 535 to allow as much travel of the interior refractor 570 within the retainer apparatus 525 as possible.

The interior retractor 570 is disposed in the retainer apparatus 525 such that the first side 600 faces toward the exterior handle assembly 35 and the second side 605 faces toward the interior handle assembly 40. As shown in FIGS. 6-8, the first side 600 is defined by a curvilinear profile when viewed along an edge of the interior retractor 570. Referring back to FIGS. 5 and 8, the second side 605 has a first ledge 615 that defines engagement surfaces 620 selectively engaged by the retractor engagement portions 395 of the interior spindle 365 such that rotation of the interior spindle 365 is converted to translational movement of the interior retractor 570.

The latch engagement portions 610 extend outward (upward in FIGS. 5 and 8) from the base 595 and are coupled to the latch assembly 30 such that the interior retractor 570 is attached to an end of the latch 60. The interior retractor 570 is permanently or always connected to the latch assembly 30 to operate the latch 60. As described herein, permanent attachment of the interior retractor 570 to the latch assembly 30 refers to the interior retractor 570 being drivingly engaged with the latch 60 during normal operation of the lock assembly 10.

The latch engagement portions 610 are spaced apart from each other and cooperate to define a channel 625 extending inward from the end of the latch engagement portions 610 toward the base 595. The channel 625 extends completely through the interior retractor 570 from the first side 600 to the second side 605 up to the inward end of the channel 625 to accommodate the pushbutton bar 200 extending through the interior retractor 570. The channel 625 is defined by a substantially cylindrical wall 630 adjacent the inward end to conform with and support the pushbutton bar 200 adjacent the cam member 300. The engagement surfaces 620 defined by the first ledge 615 angle inward toward the inward end of the channel 625 adjacent the cylindrical wall 630.

As illustrated in FIGS. 6, 7, and 11-13, the interior retractor 570 further defines a catch recess 635 in the base 595 and adjacent the inward end of the channel 625. The catch recess 635 extends partially through the base 595 from the first side 600.

FIGS. 5 and 8 show that the exterior retractor 575 is defined by an exterior retractor body that is symmetrical about the plane extending through the exterior retractor 575 along the axis 590. FIGS. 5-8, 11-13, and 16 show that the exterior retractor 575 includes a base 645 adjacent one end of the exterior retractor 575, a first side 650, and a second side 655 opposite the first side 650. The base 645 has a curvature that conforms to the curvature of the central portion 535 to allow as much travel of the exterior retractor 575 within the retainer apparatus 525 as possible. As illustrated in FIG. 6, the retractor mechanism 530 defines a distance between the bases 595, 645 of the interior and exterior retractors 570, 575 and the central portion 535 of the retainer apparatus 525, which corresponds to the maximum travel distance either retractor 570, 575 can travel when engaged by the corresponding spindle 365, 410.

The exterior retractor 575 is disposed in the retainer apparatus 525 such that the first side 650 faces toward the exterior handle assembly 35, and the second side 655 faces toward the interior handle assembly 40. The second side 655 of the exterior retractor 575 is further in communication with the first side 600 of the interior retractor 570. As shown in FIGS. 5-8, the second side 655 is defined by a curvilinear profile when viewed along an edge of the exterior retractor 575. The exterior retractor 575 is partially defined by spring channels 660 that extend upward and are accessible from adjacent the base 645, and that are further accessible from adjacent the second side 655. The spring channels 660 are engageable by the retractor mechanism springs 555 to bias the exterior retractor 575 outward from the central portion 535 of the retainer apparatus 525.

The first side 650 of the exterior retractor 575 has a second ledge 665 that defines engagement surfaces 670. The engagement surfaces 670 are selectively engaged by the retractor engagement portions 485 of the exterior spindle 410 such that rotation of the exterior spindle 410 is converted to translational movement of the exterior retractor 575.

The exterior retractor 575 is further defined by a channel 675 extending inward from an end of the exterior retractor 575 toward the base 645. The channel 675 extends completely through the exterior retractor 575 from the first side 650 to the second side 655 up to the inward end of the channel 675, and the channel 675 is defined by a substantially cylindrical wall 680 adjacent the inward end to conform with and support the pushbutton bar 200 adjacent the locking lug actuator 210. The engagement surfaces 670 defined by the second ledge 665 angle inward toward the inward end of the channel 675 adjacent the cylindrical wall 680.

As illustrated in FIGS. 5-8, and 11-13, the exterior retractor 575 further defines a locking lug recess 685 that is disposed in the base 645 and located adjacent the inward end of the channel 675. The locking lug recess 685 extends partially through the base 645 from the second side 655 toward the first side 650.

FIGS. 5-7, 11-13, 16, 17B, and 18B show the locking lug 580 that is disposed in the locking lug recess 685 and that is biased by a bias member 690 (e.g., a spring) toward the second side 655 (e.g., toward the right in FIGS. 6 and 7) into engagement with the pushbutton catch 585. As illustrated, the locking lug 580 is shaped to conform to the shape of the locking lug recess 685. The locking lug 580 includes a hole 695 extending through the locking lug 580, and a catch engagement member 700 extending outward from the exterior retractor 575. The hole 695 extends at least partially through the locking lug 580 and is engaged by the locking lug actuator 210.

FIGS. 5-7, 11-13, 16, 17B, and 18B further show the pushbutton catch 585 that is disposed in the catch recess 635 and that is biased by a bias member 705 (e.g., a spring) away from the base 595 (upward in FIGS. 6 and 7). As illustrated, the pushbutton catch 585 is shaped to conform to the shape of the catch recess 635. The pushbutton catch 585 includes a cam engagement member 710 that is selectively engageable with and by the cam member 300, and a hole 715 that is shaped to conform to and receive the catch engagement member 700.

FIG. 6 shows the lock assembly 10 in the unlocked state with the pushbutton catch 585 engaged by the locking lug 580 and spaced from the catch channel 315 of the pushbutton bar 200. FIG. 7 shows the lock assembly 10 in the locked state with the locking lug 585 disengaged from the pushbutton catch 585 due to lateral movement of the locking lug actuator 210 (toward the left in FIG. 7). In the orientation illustrated in FIG. 7, the pushbutton catch 585 is biased toward the catch channel 315 and engaged with the step 310.

Figure 19:
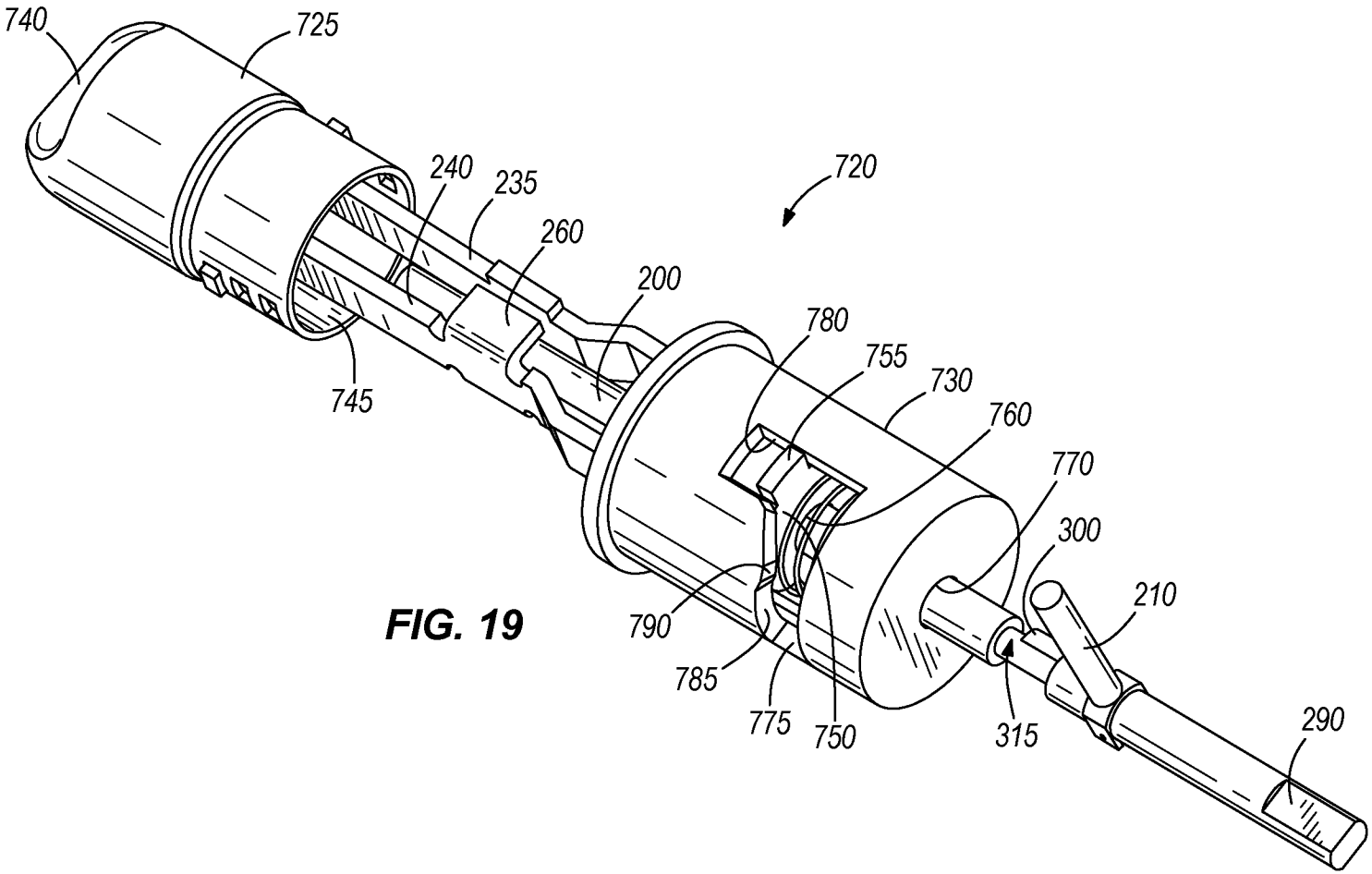
FIG. 19 is a perspective view of a push and turn button assembly for use with the lock assembly.

FIGS. 19 and 20 show another construction of the invention that has an actuator or push and turn button assembly 720 for use with the lock assembly 10. Except as described below, the push and turn button assembly 720 is the same as the pushbutton assembly 160, and common elements are given the same reference numerals. The push and turn button assembly 720 includes the connector 195, the pushbutton bar 200, the locking lug actuator 210, the apertures 230, a push and turn button 725, and an interior driver catch 730. The push and turn button 725 is substantially cylindrical and includes a push-turn interface 740 and a cavity 745 that is accessible opposite the push-turn interface 740. The push-turn interface 740 can be actuated by a user to push and turn the push and turn button assembly 720.

The second arm 240 is connected to the first arm 235 of the connector by a connector plate 750 that has a tab 755 and a hole 760 to accommodate the pushbutton bar 200. The interior driver catch 730 is defined by a hollow cylindrical body that has an access opening 765 for receiving the connector 195, a hole 770 opposite the access opening 765 to accommodate the pushbutton bar 200, and a slot 775. The slot 775 is defined by a push portion 780 that extends longitudinally along the interior driver catch 730, a turn portion 785 in communication with the push portion 780 and extending radially along the interior driver catch 205, and a ridge 790 between the push portion 780 and the turn portion 785. The tab 755 is engaged with the interior driver catch 205 within the slot 775 to accommodate push and turn movement of the pushbutton bar 200 relative to the interior driver catch 205, and the ridge holds the tab 755 in the turn portion 785 after the tab 755 is in the rotated.

FIGS. 21-26 show another construction of the invention including a lock assembly 800 that has the retractor mechanism 530 and a free spinning mechanism. Except as described below, the lock assembly 800 is the same as the lock assembly 10, and common elements are given the same reference numerals.

The lock assembly includes the latch assembly 30, the interior handle assembly 40, a chassis assembly 805 coupled to the latch assembly 30, and an exterior handle assembly 810 coupled to the chassis assembly 805. The chassis assembly 805 includes the pushbutton assembly 160 or the push and turn button assembly 720, the interior driver mechanism 165, the exterior hub 175, the interior hub 180, the clutch mechanism 185, and an exterior driver mechanism 815. The chassis assembly 805 is coupled to and drivingly engaged with the latch assembly 30 to move the latch 60 between the extended position and the retracted position.

Figure 21:
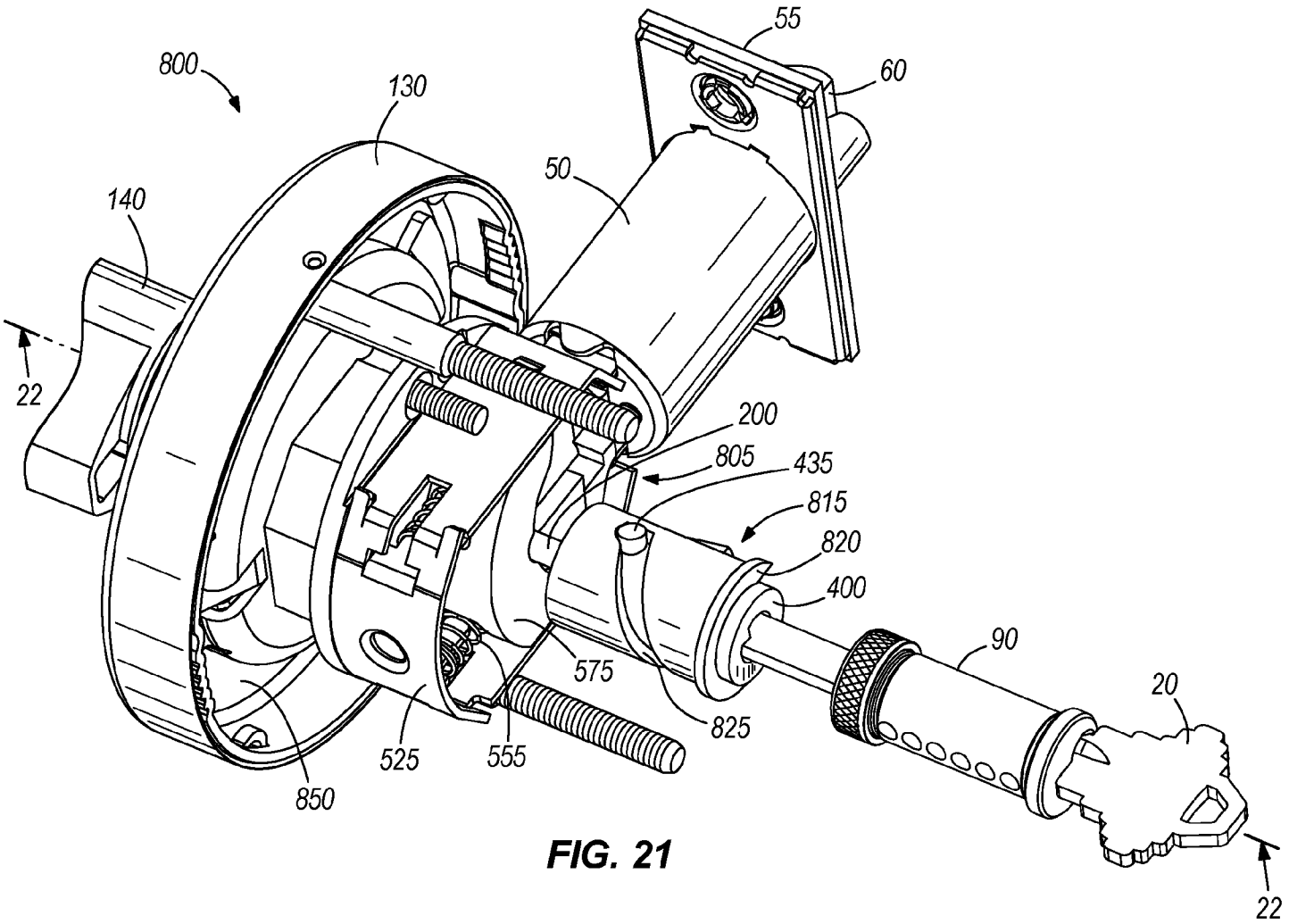
FIG. 21 is a perspective view of a portion of the lock assembly of FIG. 20 in an unlocked state and including the push and turn button assembly and another exterior spindle assembly.
Figure 23:
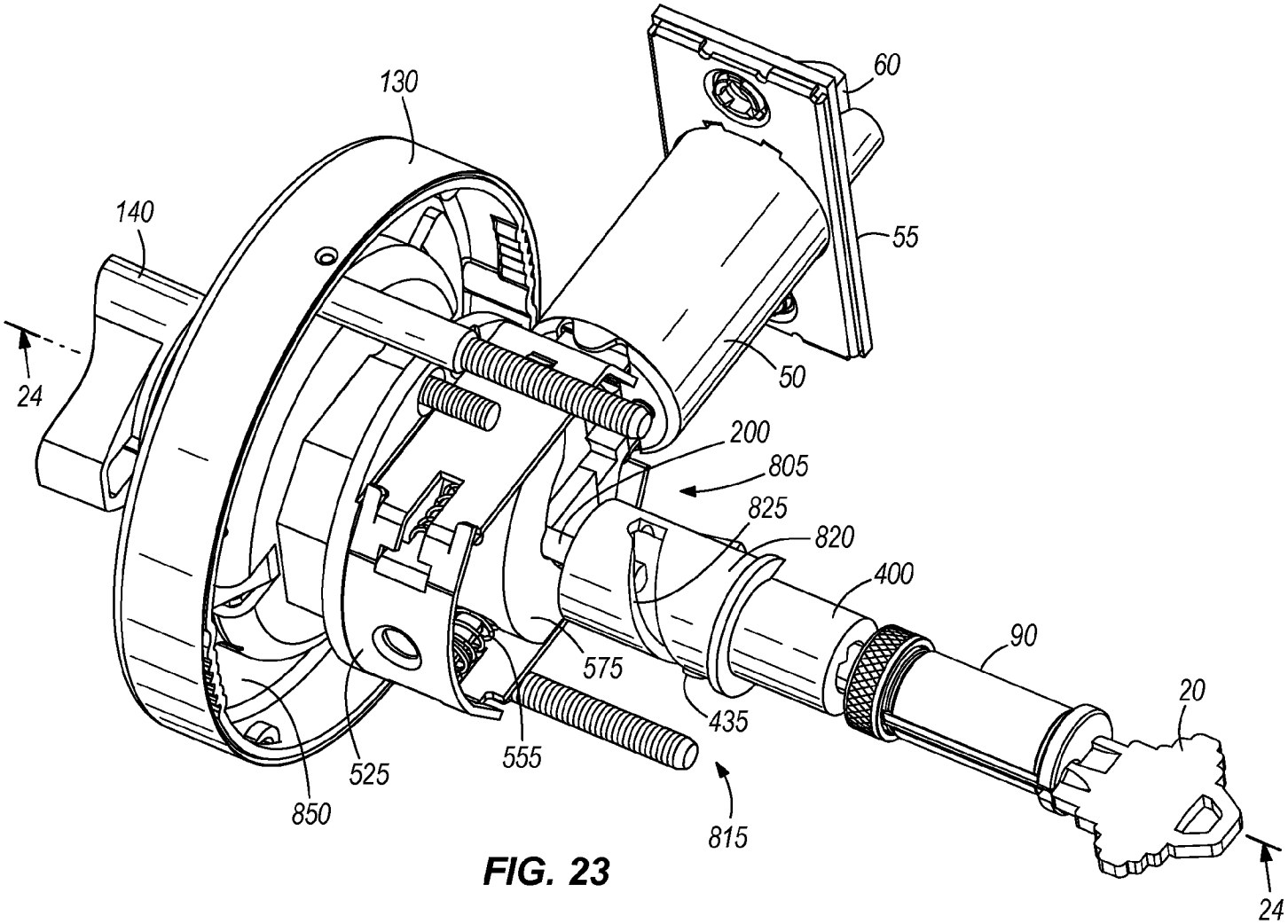
FIG. 23 is a perspective view of a portion of the lock assembly of FIG. 21 in a locked state and including the push and turn button assembly of FIG. 18 and the exterior spindle assembly.

FIGS. 21 and 23 show that the exterior driver mechanism 815 includes the driver 400, the exterior spindle 410, and an exterior driver catch 820. The exterior driver catch 820 is similar to the interior driver catch 205 and includes a circumferential helical slot 825 adjacent the second end 525 to retain the driver 400 in the access opening via engagement of the protrusion 475 with the circumferential slot 450. The helical slot 825 further allows the driver 400 to rotate in response to rotation of the pushbutton bar 200 or the driver 400 when the lock assembly 800 is locked or unlocked from inside area confined by the door 15, or from outside the area confined by the door 15. In addition, the helical shape of the slot 330 is configured to rotate the driver 400 out of engagement with the pushbutton bar 200 in response to the lock assembly 800 being adjusted to the locked position (using the key 20, the pushbutton assembly 160, or the push and turn button assembly) to allow the exterior handle 85 to free spin as described in detail below.

FIGS. 22 and 24-26 show the exterior handle assembly 810 includes the lock cylinder 90, the first trim piece 75, the exterior handle 85, and a handle alignment mechanism 835. The first trim piece 75 has two tabs 830 (e.g., one shown—formed by a punch process) located radially outward from the center of the first trim piece 75 and laterally spaced from each other to define bias member supports.

Figure 25:
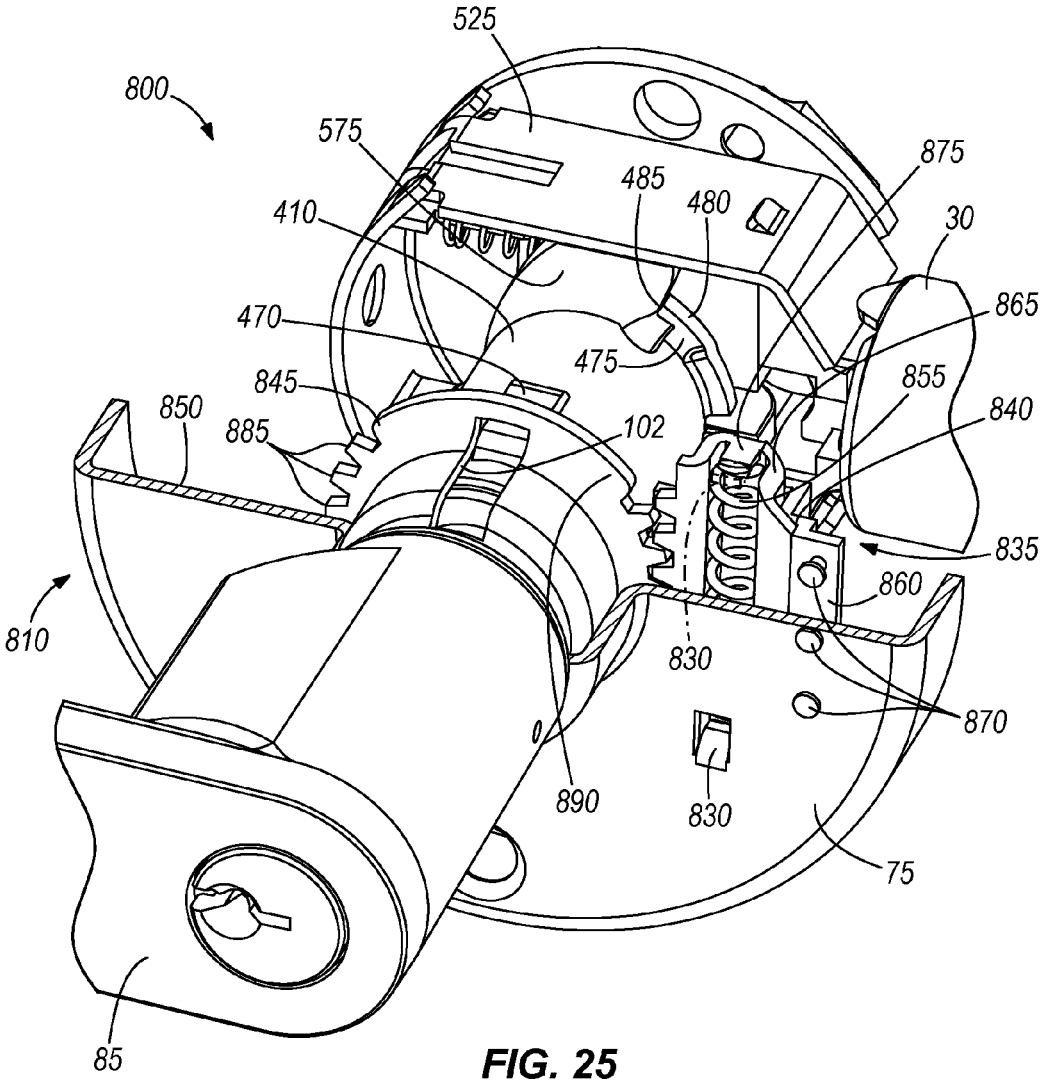
FIG. 25 is a perspective view of a portion of the lock assembly of FIG. 20 in a locked state and including a chassis assembly, an exterior spindle assembly, an exterior handle assembly in a non-rotated state, and a latch assembly in a latched state.
Figure 26:
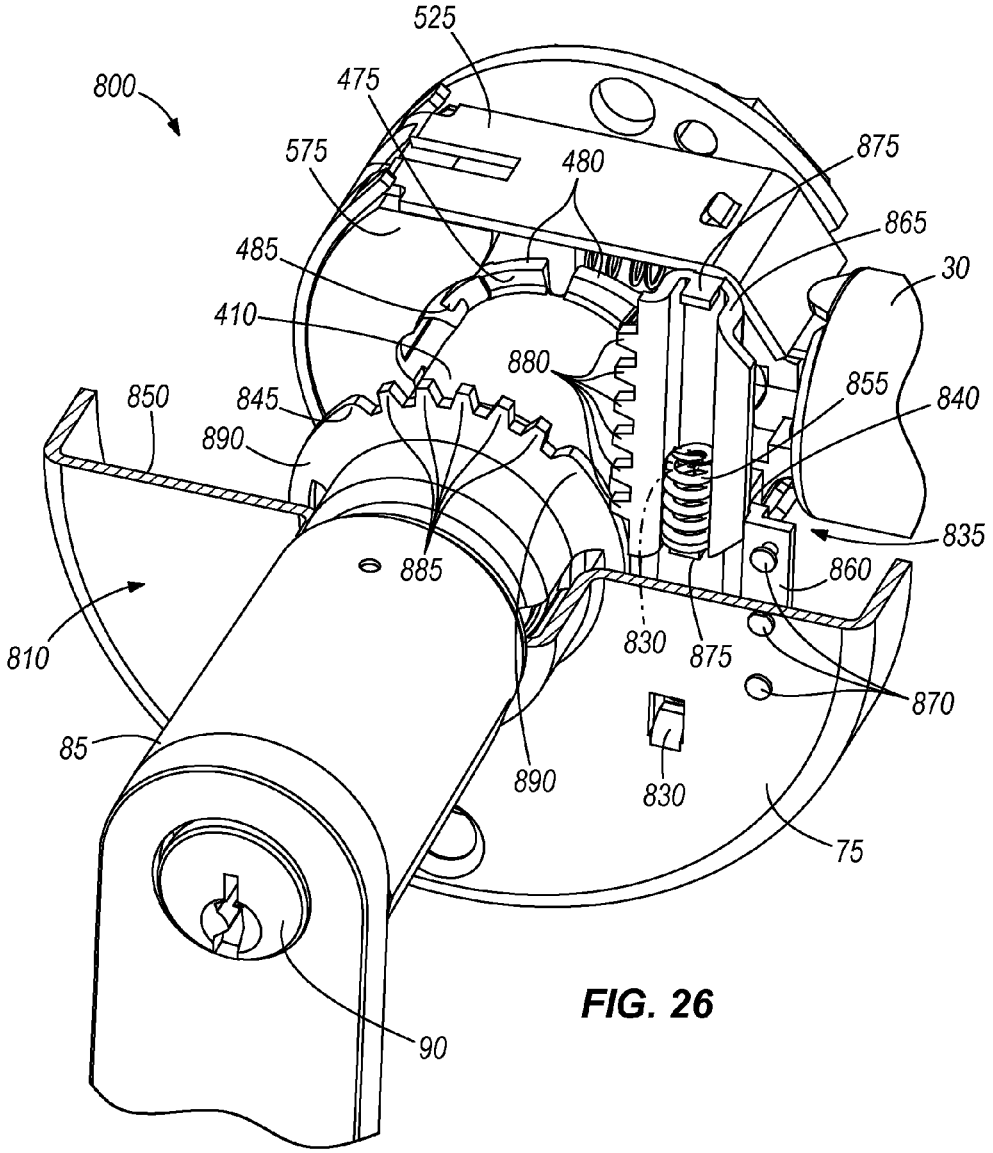
FIG. 26 is another perspective view of a portion of the lock assembly of FIG. 24 in the locked state and including the chassis assembly, the exterior spindle assembly, the exterior handle assembly in a rotated state, and the latch assembly in the latched state.

The handle alignment mechanism 835 includes a rack mechanism 840 and a pinion mechanism 845 that cooperate with each other and the exterior handle 85 to maintain alignment of the exterior handle 85 relative to other components of the lock assembly 10 when the exterior handle 85 is rotated. The rack mechanism 840 is coupled to an interior surface 850 of the first trim piece 75, and includes a bias member 855 (e.g., a spring), a rack guide 860, and a rack 865. As shown in FIG. 25, the bias member 855 abuts the tabs 830 when the handle alignment mechanism 835 is in a non-rotated state corresponding to the exterior handle 85 being in the non-rotated state. As shown in FIG. 26, the bias member 855 is separated from one of the tabs 830 in response to movement of the rack 865 caused by rotation of the exterior handle 85.

The rack guide 860 is secured to the first trim piece 75 with suitable fasteners 870 (e.g., rivets, screws, etc.) at the most radially outward-most portion of the rack guide 860 relative to the center of the first trim piece 75. The rack guide 860 does not include fasteners 870 adjacent the inward-most portion relative to the center of the first trim piece 75 to avoid interference with the pinion mechanism 845. In this manner, the rack guide 860 substantially encases the rack 865 to clamp the rack 865 onto the first trim piece 75.

The rack 865 is positioned between the first trim piece 75 and the rack guide 860, and the rack 865 is laterally movable between a first position corresponding to when the exterior handle 85 is in the non-rotated position, and a second position corresponding to when the exterior handle 85 is in the rotated position. The rack 865 includes bias member tabs 875 and a plurality of rack teeth 880. The bias member tabs 875 are engageable with respective ends of the bias member 855 to separate one end of the bias member 855 from the corresponding tab, thereby compressing the bias member 855 against the other tab, as the rack 865 moves from the first position to the second position such that the rack 865 is biased to the first position by the bias member 855. The rack teeth 880 are in communication with and engaged by the pinion mechanism 845 to facilitate movement of the rack 865 between the first and second positions in response to rotation of the exterior handle 85 between the non-rotated and rotated positions.

The pinion mechanism 845 is coupled to and rotatable with the exterior handle 85 and is engaged with the rack mechanism 840 to move the rack 865 between the first and second positions. The pinion mechanism 845 is rotatable relative to the first trim piece 75. The pinion mechanism 845 includes pinion teeth 885 on diametrically opposite sides of the pinion mechanism 845 and free spinning portions 890 disposed circumferentially between the pinion teeth 885. The pinion teeth 885 engage or mesh with the rack teeth 880 to transfer rotational movement of the exterior handle 85 to translational movement of the rack mechanism 840. The free spinning portions 890 have smooth, non-toothed surfaces to facilitate free spinning or free rotation of the exterior handle 85 relative to the rack mechanism 840 when the rack 865 reaches the second position.

The components of the lock assembly 10 can be assembled several different ways relating to the order that the components are assembled. One order of assembly is described below, although other orders of assembly are possible and considered herein. For example, one alternative method of assembly can include assembling the various components of each of sub-assembly of the lock assembly 10 (e.g., the latch assembly 30, the exterior handle assembly 35, the interior handle assembly 40, and the chassis assembly 45) and then assembling these sub-assemblies together to form the lock assembly 10. Using this sub-assembly approach, it will be apparent the order that each sub-assembly is assembled can vary. Assembly of the latch assembly 30 is well known, and will not be discussed in detail.

The driver 400 is inserted into the exterior driver catch 405 via engagement of the protrusion 475 with the circumferential slot 450. The driver-exterior driver catch assembly is then inserted into the exterior spindle 410 so that the tab member 455 is engaged with the aperture 540 in the exterior spindle 410. The assembled exterior driver mechanism 170 is engaged with the exterior hub 175 by passing the exterior driver mechanism 170 between the chassis members 495 and into the cavity 490.

The retractor mechanism springs 555 are coupled to the posts 550, and the retainer apparatus 525 is then coupled to the exterior hub 175 between the chassis members 495. Thereafter, the exterior retractor 575 is then positioned in the retainer apparatus 525 so that the retractor mechanism springs 555 engage the spring channels 660 to bias the exterior refractor 575 toward the retainer elements 560. The locking lug 580 and the bias member 690 are inserted into the locking lug recess 685 of the exterior retractor 575, and the pushbutton catch 585 and the bias member 705 are inserted into the catch recess 635 of the interior retractor 570 prior to attaching the interior retractor 570 to the exterior retractor 575. The interior retractor 570 is then engaged with the exterior retractor 575 so that the second side 655 of the exterior retractor 575 abuts the first side 600 of the interior refractor 570. To accomplish this, the locking lug 580 is pressed toward the back of the locking lug recess 685 (to the left in FIGS. 5-7) and the pushbutton catch 585 is pressed toward the back of the catch recess 635 (downward as viewed in FIGS. 5-7) so that the hole 715 in the pushbutton catch 585 is aligned with the catch engagement member 700. After the interior retractor 570 is engaged with the exterior retractor 575, the locking lug 580 is biased outward and engaged with the pushbutton catch 585 within the hole 715.

The push and turn button assembly 720 is assembled the same way as the pushbutton assembly 160, and as such, the assembly process for the push and turn button assembly 720 will not be discussed separately. With regard to the pushbutton assembly 160, the connector 195 is attached to the pushbutton 190 via the apertures 230, and the pushbutton bar 200 is inserted through the hole 255 in the connector plate 250. The clip 275 is then attached to the pushbutton bar 200 to secure the pushbutton bar 200 to the pushbutton 190 and the connector 195. The bias member 345 is placed in the interior driver catch 205 via the access opening 320, and then the interior driver catch 205 is engaged with the pushbutton bar 200 by sliding the pushbutton bar 200 through the hole 325.

The connector 195 is positioned in the interior driver catch 205 so that the bottom of the connector plate 250 is engaged with the interior driver catch 205 within the slot 330. The interior spindle 365 can be attached to the interior driver catch 205 before or after the interior driver catch 205 is coupled to the connector 195. After the interior spindle 365 is attached to the interior driver catch 205, the locking lug actuator 210 is attached to the pushbutton bar 200 within the lug attachment channel 285 using the spring pin 360. The pushbutton bar 200 and the locking lug actuator 210 are passed through the channels 625, 675 so that the locking lug actuator 210 is aligned and engaged with the hole 695 in the locking lug 580. The pushbutton assembly 160 and the interior spindle 365 are then coupled to the interior retractor 570 via the second flange 475 and the first ledge 615. The driver engagement member 290 is engaged with the driver 400 within the second recess 430.

After the chassis assembly 45 is assembled, the interior hub 180 is passed over the pushbutton assembly 160 and the interior spindle 365 so that the interior hub 180 partially rests on the second flange 475. The fastener plate 515 is placed in abutment with the chassis members 495 of the exterior hub 175, and the fasteners 505 are used to secure the interior hub 180 to the exterior hub 175 to fully construct the chassis assembly 45.

The exterior handle assembly 35 is assembled by engaging the exterior handle 85 with the first trim piece 75, and inserting the lock cylinder 90 into the central cavity 490 110 so the lock cylinder 90 can be accessed using an appropriate key 20 from outside the housing portion 95. The first cover plate 80 can be attached to the first trim piece 75 opposite the exterior handle 85 before or after the lock cylinder 90 is placed in the central cavity 110. The interior handle assembly 40 is assembled by engaging the interior handle 140 with the second trim piece 130, and attaching the second cover plate 135 to the second trim piece 130 opposite the exterior handle 85.

With reference to FIGS. 1 and 5, the latch assembly 30 is positioned in the door 15, and the constructed chassis assembly 45 is then inserted into the opening 25 in the door 15 to operatively engage with the latch assembly 30. The exterior handle assembly 35 is then coupled to the door 15, and is engaged with the exterior driver mechanism 170 via engagement of the tailpiece 125 with the driver 400. The interior handle assembly 40 is coupled to the door 15 opposite the exterior handle assembly 35 using the fasteners 65, and the interior handle assembly 40 is engaged with the pushbutton assembly 160 such that the pushbutton 190 is exposed through the interior handle 140 for operation by a user.

Except as described below, the components of the lock assembly 800 are assembled in the same manner as the components of the lock assembly 10. The exterior handle assembly 810 is assembled by engaging the pinion mechanism 845 to the housing portion 95 within the cavity 110. The rack mechanism 840 is attached to the interior surface 850 of the first trim piece 75 by nesting the rack 865 and the bias member 855 in the rack guide 860, and then fastening the rack guide 860 to the first trim piece 75 using the fasteners 870 so the rack teeth 880 are engaged with the pinion teeth 885.

Figure 13:
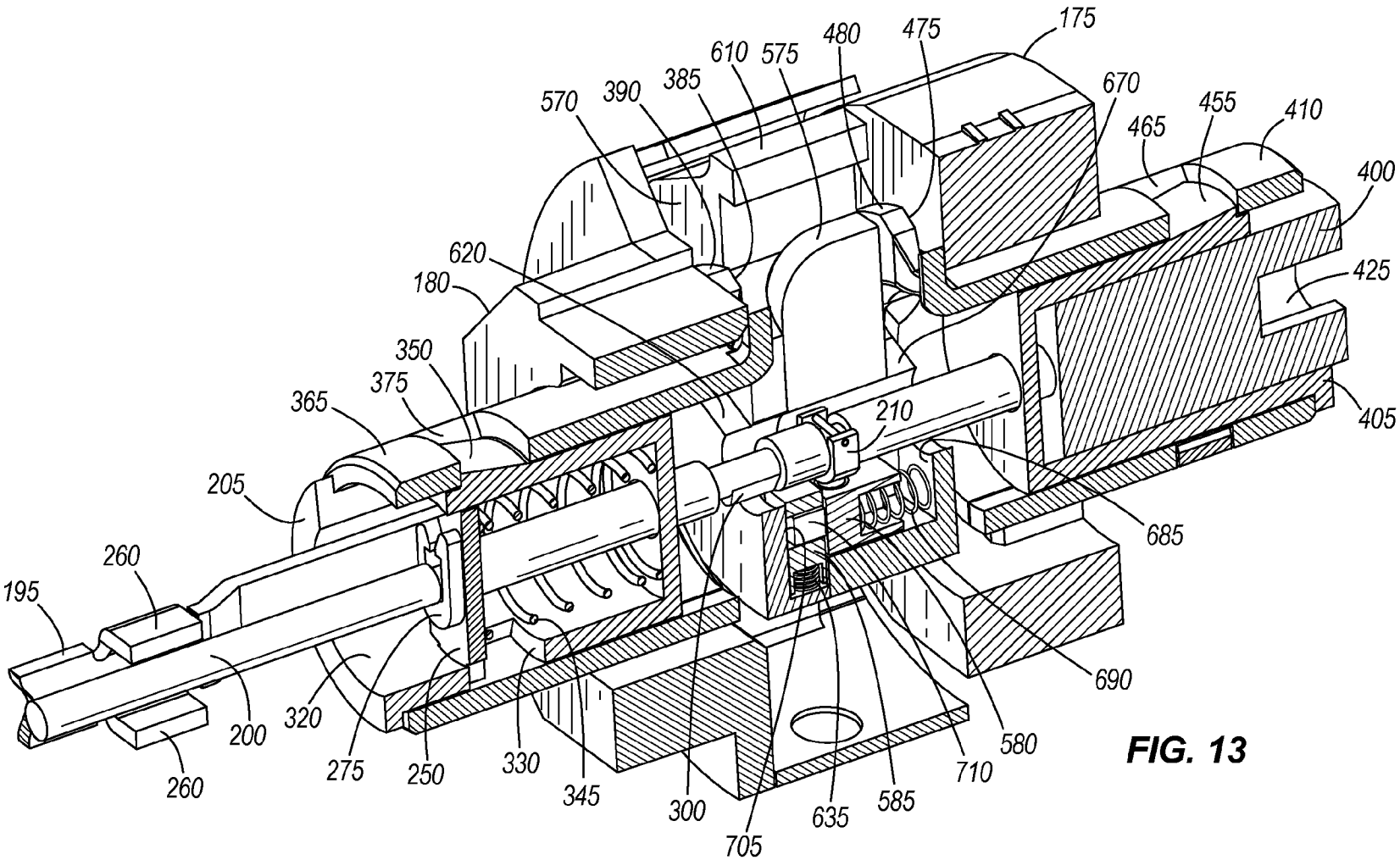
FIG. 13 is another section view taken along line 13-13 of FIG. 4 illustrating components of the pushbutton assembly and the chassis assembly in a third orientation.

FIGS. 2, 3, 6, and 13 show the lock assembly 10 in the unlocked state and the interior and exterior handles 85, 140 in the non-rotated state. In the unlocked, non-rotated orientation, the latch 60 extends outward from the body 50 of the latch assembly into the strike plate. As illustrated in FIGS. 6 and 13, the pushbutton 190 and the pushbutton bar 200 are biased toward the interior handle assembly 40 such that the pushbutton 190 is partially exposed relative to the interior handle 140. The bias member 690 assists with biasing the pushbutton bar 200 via the locking lug actuator 210, and further biases the locking lug 580 in engagement with the pushbutton catch 585. Because the exterior and interior handles 85, 140 are in the non-rotated state, the interior and exterior retractors 570, 575 are biased away from the central portion 535 toward the gap 565.

The pushbutton bar 200, the locking lug actuator 210, the cam member 300, the catch channel 315, the locking lug 580, and the pushbutton catch 585 cooperate to partially define an engagement mechanism of the lock assembly 10 that selectively permits the exterior retractor 575 to move relative to the interior retractor 570. The inter-engagement of the locking lug actuator 210, the locking lug 580, and the pushbutton catch 585 in the unlocked state cooperates to couple the exterior retractor 575 to the interior retractor 570 such that movement of one of the retractors 570, 575 causes similar movement of the other retractor 570, 575. FIGS. 2, 14, 16, 17A, and 17B show the lock assembly 10 in the unlocked state with the exterior handle 85 in the non-rotated state and the interior handle 140 in the rotated state (illustrated as phantom lines in FIG. 2). Rotation of the interior handle 140 rotates the interior spindle 365 a corresponding amount, which in turn engages the first ledge 615 to move the interior retractor 570 toward the retracted position.

The exterior retractor 575 is pushed by the interior retractor 570 due to the complementary shapes of the retractors 570, 575 and the inter-engagement of the locking lug actuator 210, the locking lug 580, and the pushbutton catch 585 in the unlocked state. Rotation of the interior handle 140 moves the retractors 570, 575 at least a portion of the maximum travel distance D1, and the latch 60 is in the retracted position when the retractors are moved the entire distance D1. In the retracted position, the latch 60 is disengaged from the strike plate, which allows the door 15 to be opened.

Figure 3:
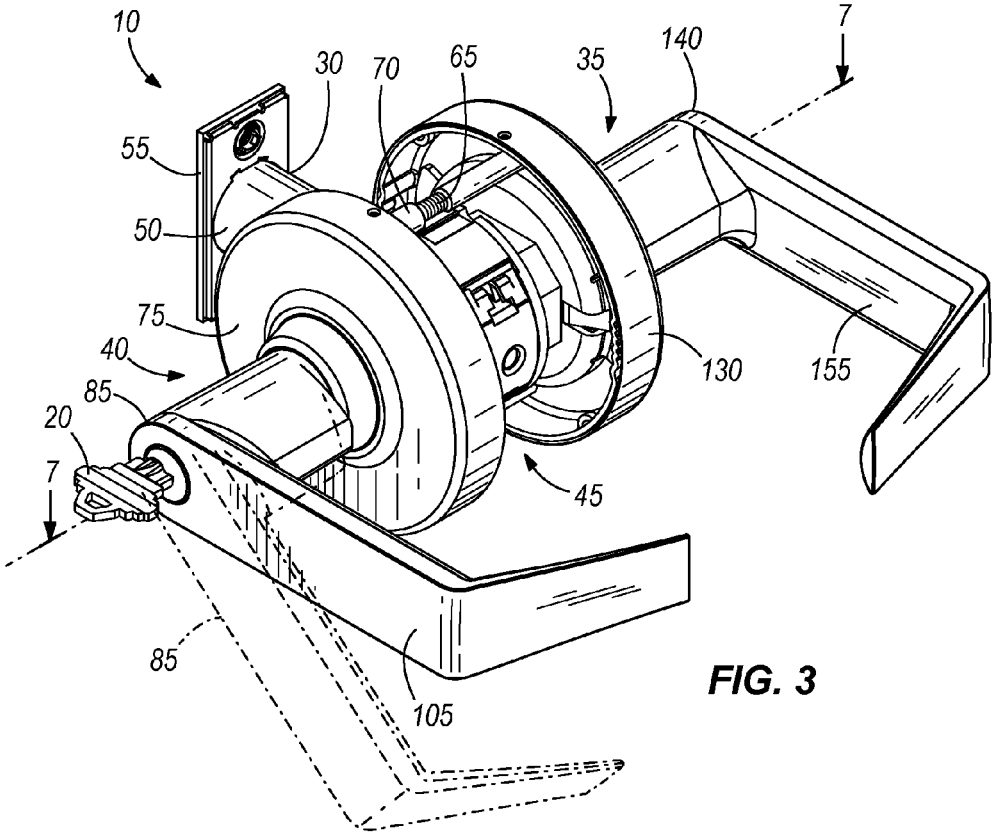
FIG. 3 is another assembled perspective view of the lock assembly of FIG. 1 in a locked state.
Figure 4:
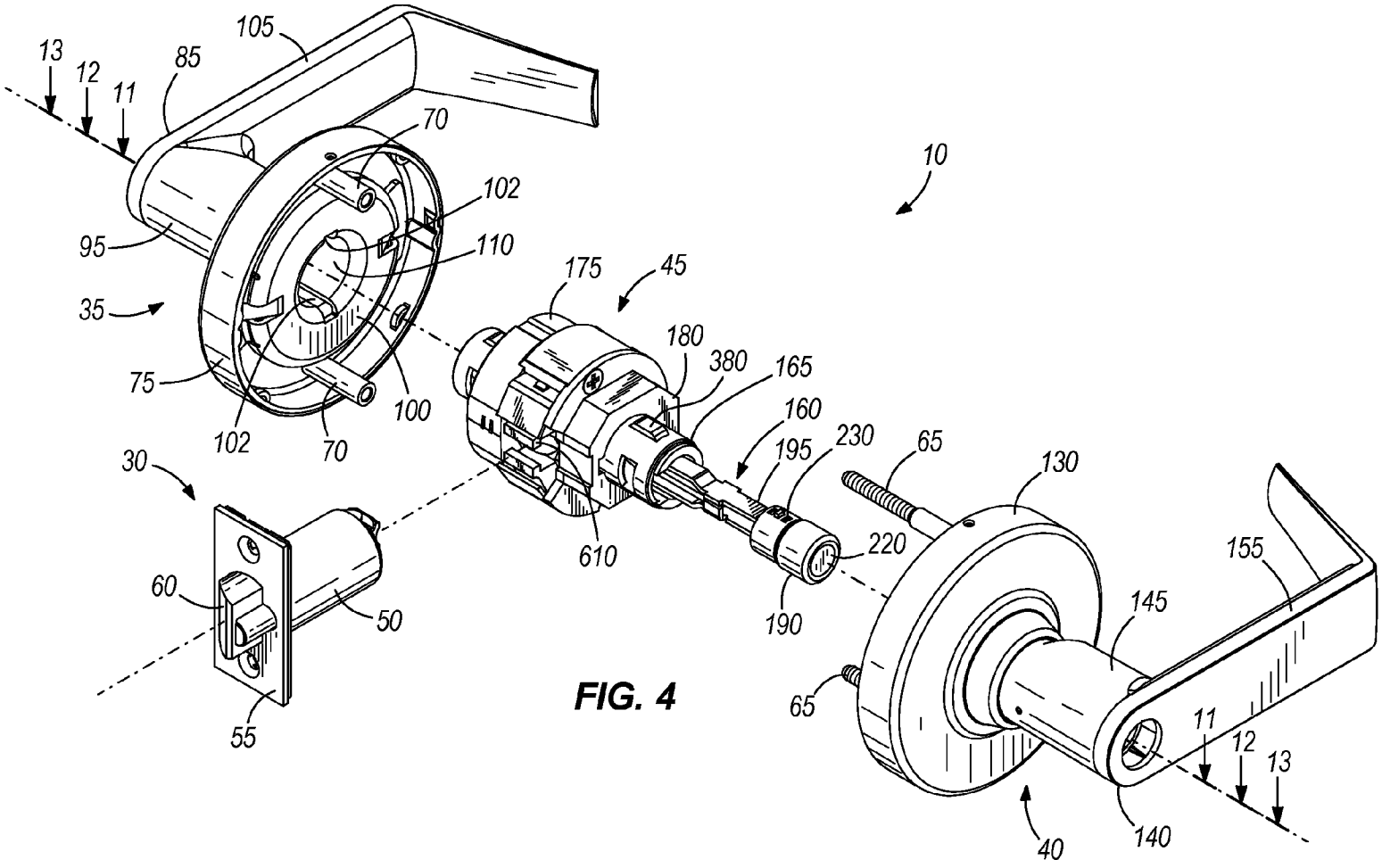
FIG. 4 is a partially exploded perspective view of the lock assembly of FIG. 2 including an interior lock handle assembly, an exterior lock handle assembly, a latch assembly, a pushbutton assembly, and a chassis assembly.

FIGS. 3 and 15 show the lock assembly 10 in the unlocked state with the exterior handle 85 in the rotated state (illustrated as phantom lines in FIG. 3) and the interior handle 140 in the non-rotated state. Rotation of the exterior handle 85 rotates the exterior spindle 410 a corresponding amount, which in turn engages the second ledge 665 to move the exterior retractor 575 toward the refracted position. The interior retractor 570 is pulled by the interior retractor 570 due to the inter-engagement of the locking lug actuator 210, the locking lug 580, and the pushbutton catch 585 in the unlocked state. Rotation of the exterior handle 85 moves the retractors 570, 575 at least a portion of the maximum travel distance, and the latch 60 is in the retracted position when the retractors are moved the entire distance D1. In the retracted position, the latch 60 is disengaged from the strike plate, which allows the door 15 to be opened.

Figure 11:
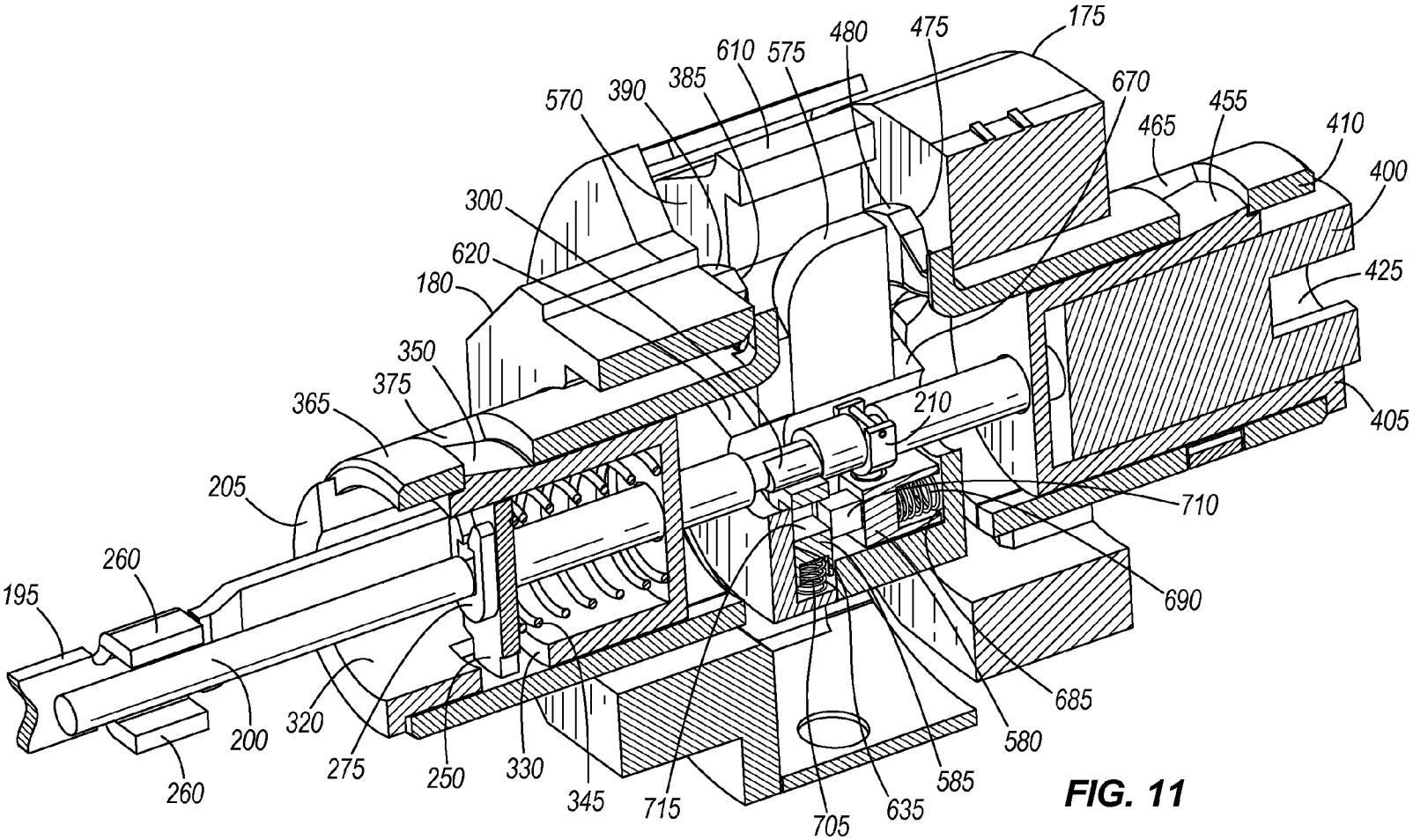
FIG. 11 is a section view taken along line 11-11 of FIG. 4 illustrating components of the pushbutton assembly and the chassis assembly in a first orientation.

FIGS. 2, 3, 7, and 11 show the lock assembly 10 in the locked state and the interior and exterior handles 85, 140 in the non-rotated position. As described above, FIG. 6 shows the lock assembly 10 in the unlocked state without rotation of the handles. Referring to FIGS. 7 and 11, the lock assembly 10 can be varied from the unlocked state to the locked state by pushing the pushbutton 190 inward relative to the interior handle 140. When the pushbutton 190 is pressed, the pushbutton bar 200 moves toward the driver 400 (toward the left in FIG. 7) against the bias of the bias member 345 retained by the interior driver catch 205. The locking lug actuator 210 moves with the pushbutton bar 200, which in turn disengages the locking lug 580 from the pushbutton catch 585.

As illustrated in FIGS. 7 and 11, inward or leftward movement of the pushbutton bar 200 relative to the interior driver catch 205 and the interior spindle 365 also aligns the cam engagement member 710 with the step 310. As illustrated in FIG. 11, the cam member 300 is out of alignment with the cam engagement member 710 such that the cam profile does not engage the pushbutton catch 585 to move the pushbutton catch 585 toward the back of the catch recess 635 (i.e., downward in FIGS. 7 and 11). Instead, the pushbutton catch 585 is engaged with the step 310 to inhibit movement of the pushbutton bar 200 to the unbiased position (i.e., toward the right in FIGS. 7 and 11). As a result, the exterior retractor 575 is disengaged from the interior retractor 570 when the lock assembly 10 is in the locked state. In the locked, non-rotated orientation, the latch 60 extends outward from the body 50 of the latch assembly 30 into the strike plate to hold the door 15 in the closed position.

Figure 2:
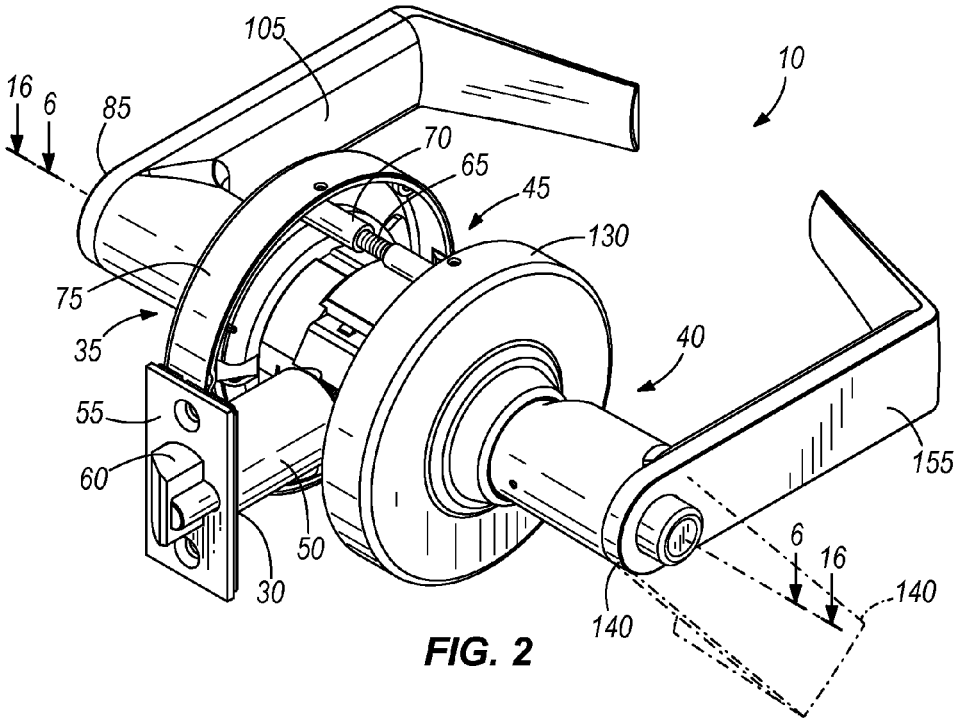
FIG. 2 is an assembled perspective view of the lock assembly of FIG. 1 in an unlocked state.
Figure 14:
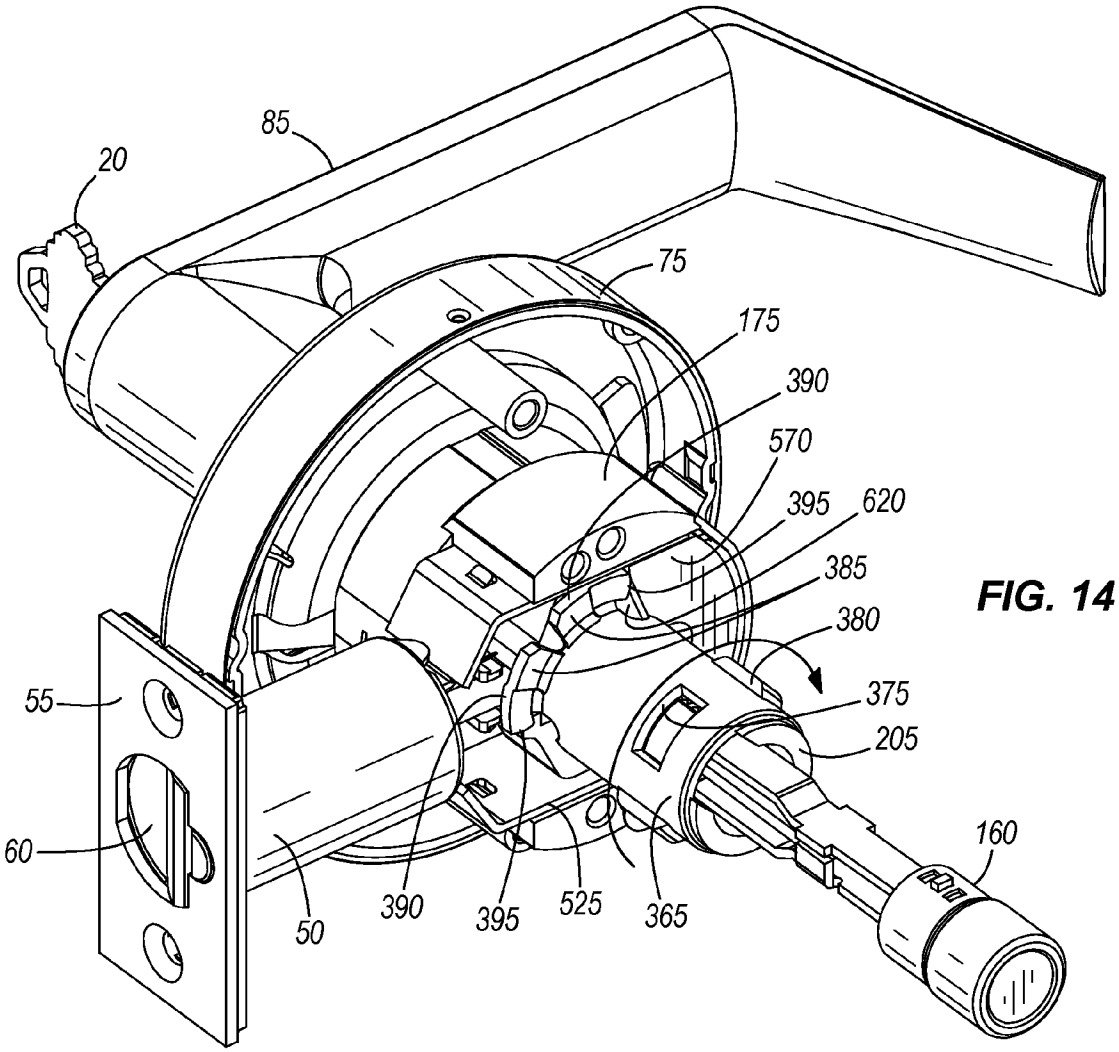
FIG. 14 is a perspective view of a portion of the lock assembly including the exterior handle assembly, the pushbutton assembly, the chassis assembly, and the latch assembly in the unlocked state and the interior handle assembly rotated.

FIGS. 2 and 14 show the lock assembly 10 in the locked state and the interior handle 140 in the rotated state (illustrated as dashed lines in FIG. 2). With further reference to FIGS. 7 and 11, the interior handle 140 can be rotated so that the interior spindle 365 engages and moves the interior retractor 570 toward the central portion 535 of the retainer apparatus 525 due to the permanent connection between the latch assembly 30 and the interior refractor 570. As described with regard to the lock assembly 10 in the unlocked state and the interior handle 140 being in the rotated state, the exterior retractor 575 is pushed by the interior retractor 570 due to the complementary shapes of the retractors 570, 575. Rotation of the interior handle 140 moves the interior and exterior refractors 570, 575 at least a portion of the distance D1, and the latch 60 is moved to the retracted position when the retractors 570, 575 are moved the entire distance D1. In the refracted position, the latch 60 is disengaged from the strike plate, allowing the door 15 to be opened. Rotation of the interior handle 140 moves the latch 60 to the retracted state when the lock assembly 10 is in the locked state to permit egress from inside the door 15 to outside the door 15.

Figure 18B:
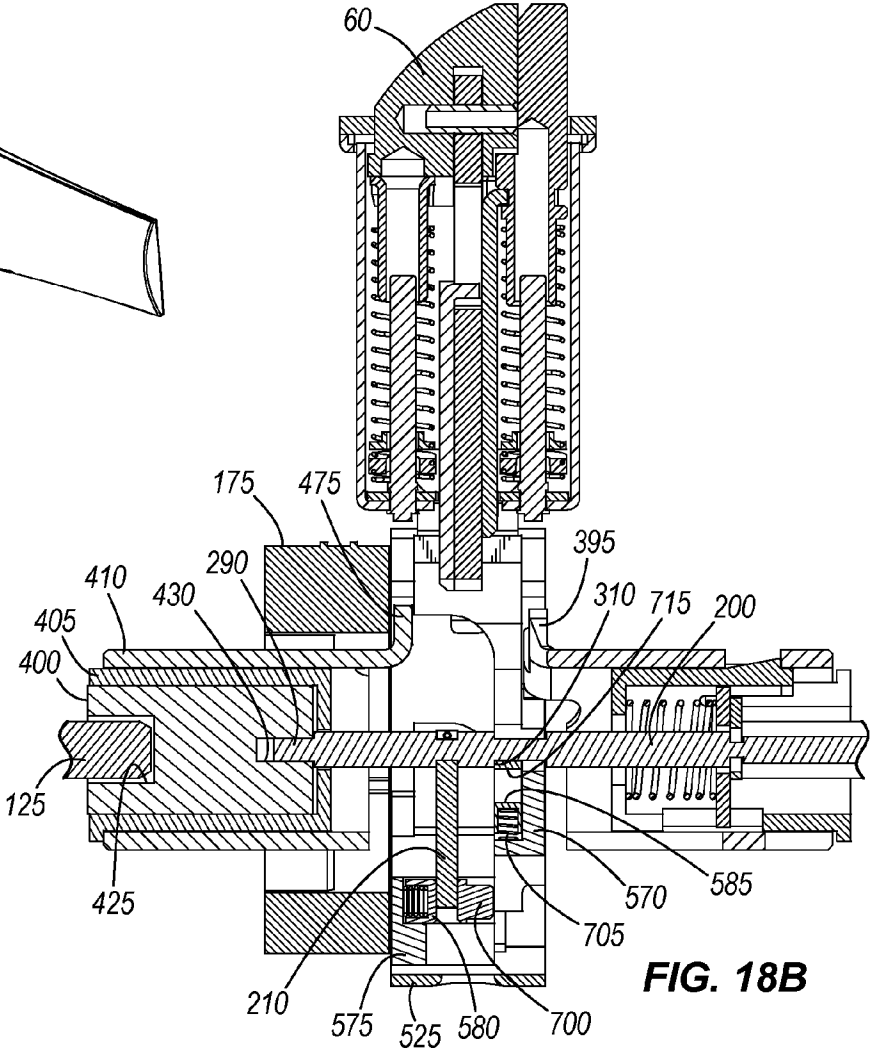
FIG. 18B is a perspective view of the lock assembly taken along line 18B-18B of FIG. 18A.
Figure 18A:
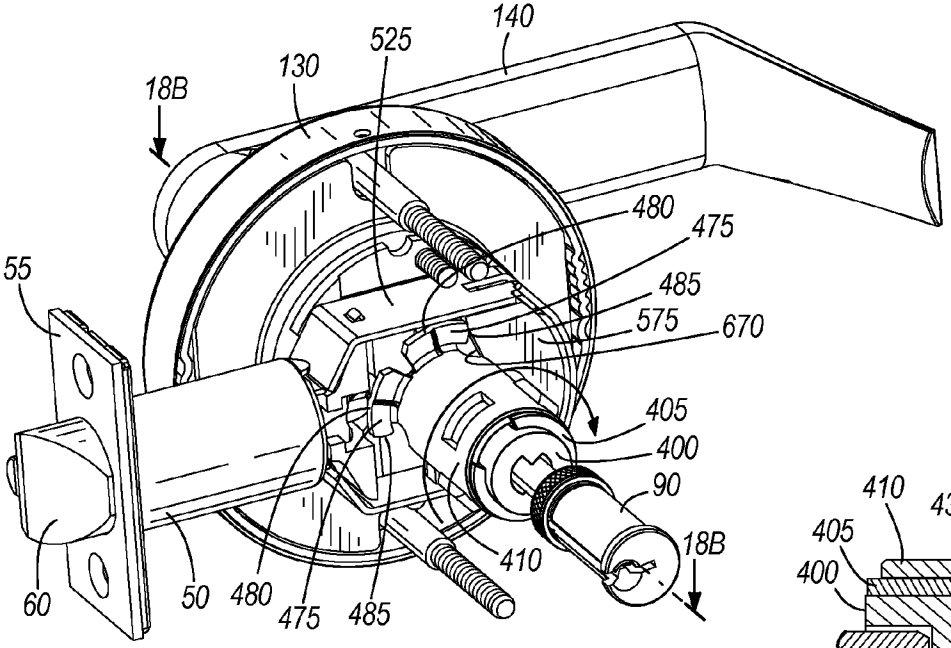
FIG. 18A is a perspective view of a portion of the lock assembly including the interior handle assembly, the chassis assembly, the latch assembly, a lock cylinder, and an exterior spindle assembly in the locked state and the exterior handle assembly in a rotated position.

FIGS. 3, 18A, and 18B show the lock assembly 10 in the locked state and the exterior handle 85 in the rotated position (illustrated as dashed lines in FIG. 3). When the lock assembly 10 is in the locked state, it is undesirable to allow the latch 60 to be moved to the retracted state in response to rotation of the exterior handle 85. As illustrated in FIGS. 18A and 18B, rotation of the exterior handle 85 rotates the exterior spindle 410 a corresponding amount, which in turn engages the second ledge 665 to move the exterior retractor 575 toward the retracted position abutting the central portion 535 of the retainer apparatus 525. Due to disengagement of the locking lug 580 from the pushbutton catch 585, the interior retractor 570 is not moved by the exterior retractor 575 and the latch 60 remains engaged with the strike plate. In other words, rotating the exterior handle 85 does not retract the latch 60 when the lock assembly 10 is in the locked state.

Figure 12:
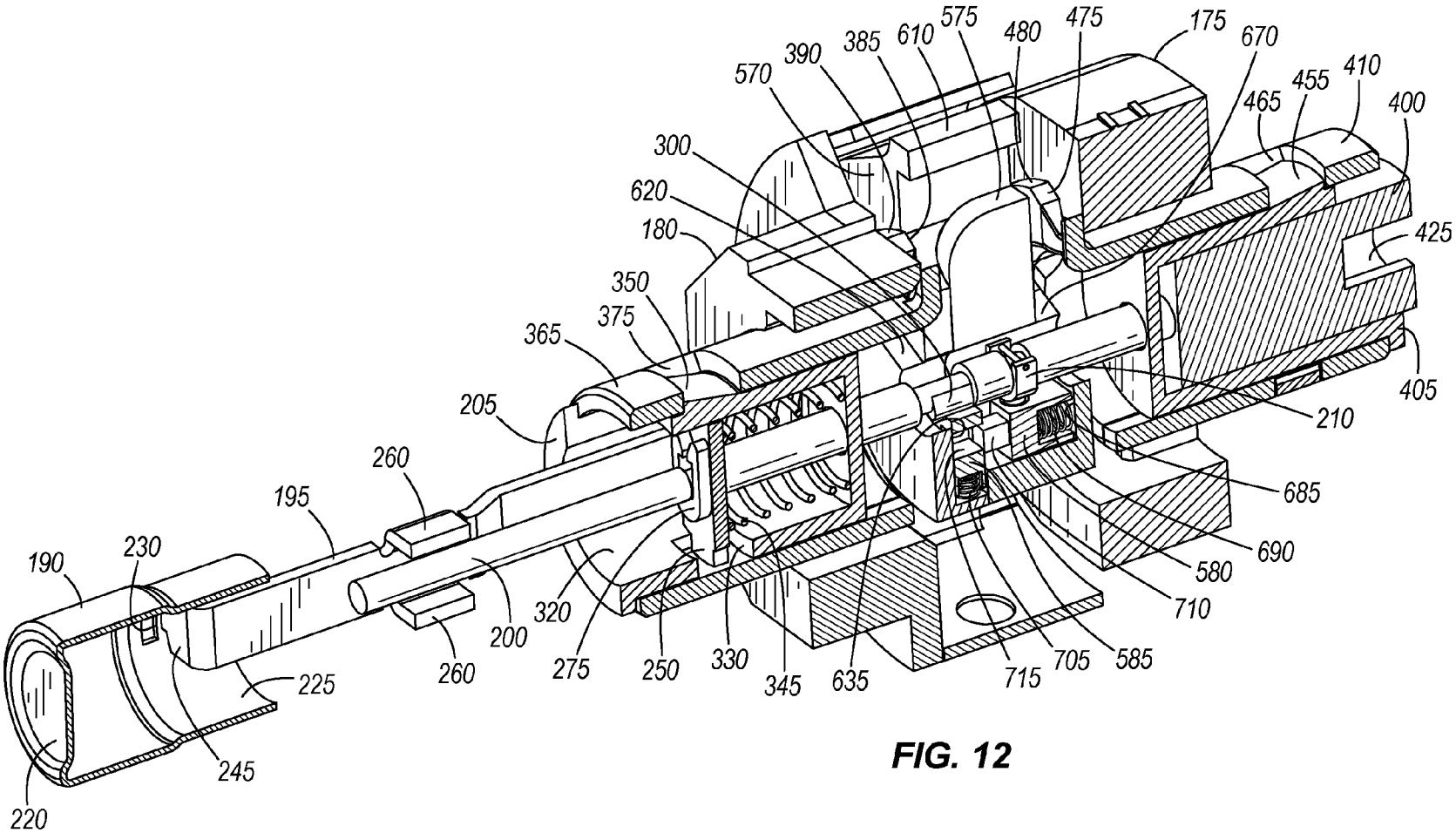
FIG. 12 is another section view taken along line 12-12 of FIG. 4 illustrating components of the pushbutton assembly and the chassis assembly in a second orientation.

FIGS. 11-13 show the lock assembly 10 in different states of operation between the locked state (FIG. 10) and the unlocked state (FIG. 13). To unlock the lock assembly 10 from outside (i.e., using the exterior handle assembly 35), a user inserts an appropriate key 20 into the lock cylinder 90 and rotates the plug 120. FIG. 11 illustrates the lock assembly 10 in the locked state before the key 20 is inserted into the plug 120.

The tailpiece 125 rotates in response to insertion of the key 20 and rotation of the plug 120. The tailpiece 125 transfers rotation to the driver 400 via engagement within the first recess 425 such that the driver 400 rotates within the slot 450 of the exterior driver catch 405. Due to the engagement of the pushbutton bar 200 with the driver 400 within the second recess 430, the rotative movement of the driver 400 transfers to the pushbutton bar 200. As illustrated in FIG. 12, the cam member 300 rotates into engagement with the cam engagement member 710 in response to rotation of the pushbutton bar 200. As the cam member 300 continues to rotate in response to rotation of the driver 400 (caused by continued rotation of the key 20 in the plug 120), the cam member 300 pushes the pushbutton catch 585 toward the back of the channel 625 (downward in FIG. 12) until the locking lug recess 685 is aligned with the catch engagement member 700. With reference to FIG. 13, the bias of the pushbutton bar 200 toward the interior handle assembly 40 (to the right in FIG. 13), forces the locking lug 580 into engagement with the pushbutton catch 585.

The lock assembly 10 is in the unlocked state when the locking lug 580 engages the pushbutton catch 585. As described above, the interior retractor 570 and the exterior refractor 575 are coupled to each other when the lock assembly 10 is in the unlocked state such rotation of either the interior spindle 365 or the exterior spindle 410 via the corresponding handle 85, 140 moves the latch 60 to the retracted position.

Except as described below, the lock assembly 10 including the push and turn button assembly 720 illustrated in FIGS. 19 and 20 operates in the same manner as the lock assembly 10 including the pushbutton assembly 160. Specifically, the push and turn button assembly 720 operates using a push and turn motion as opposed to the push-only motion of the pushbutton assembly 160. To lock the lock assembly 10 using the push and turn button assembly 720, a user engages the push-turn button interface 740 to move the tab 755 longitudinally and then laterally within the slot 775 of the interior driver catch 730. This push and turn motion pushes or moves the pushbutton bar 200 inward and further rotates the pushbutton bar 200. In response to this motion, the locking lug actuator 210 disengages the locking lug 580 from the pushbutton catch 585. Rotation of the pushbutton bar 200 does not rotate the locking lug actuator 210 because the locking lug actuator 210 freely rotates within the lug attachment channel 285. In the locked state, the lock assembly 10 operates in response to rotation of either the exterior handle 85 or the interior handle 140 as described with regard to the pushbutton assembly 160.

To unlock the lock assembly 10, a user inserts an appropriate key 20 into the lock cylinder 90 and rotates the plug 120. The tailpiece 125 rotates in response to insertion and rotation of the plug 120, which rotates the driver 400 and the pushbutton bar 200. Rotation of the pushbutton bar 200 rotates the tab 755 within the turn portion 785 of the slot 775 so the tab 755 is aligned with the push portion 780.

The cam member 300 rotates into engagement with the cam engagement member 710 in response to rotation of the pushbutton bar 200, which pushes on the pushbutton catch 585 until the locking lug 580 can engage the locking lug recess 685. The bias of the pushbutton bar 200 toward the interior handle assembly 40 forces the locking lug 580 into engagement with the pushbutton catch 585 while simultaneously forcing the tab 755 along the push portion 780 of the slot 775 so that the push and turn button 725 is biased outward from the interior handle 140. In this manner, the lock assembly 10 is varied from the locked state to the unlocked state using the appropriate key 20, and the interior retractor 570 and the exterior retractor 575 are coupled to each other when the lock assembly 10 is in the unlocked state such rotation of either the interior spindle 365 or the exterior spindle 410 via the corresponding handle 85, 140 moves the latch 60 to the retracted position.

In the construction of the invention illustrated in FIGS. 21-26, the lock assembly 800 includes the free spinning mechanism that allows the exterior handle 85 to freely rotate without damaging the internal components of the lock assembly 800 in the locked state. Except as described below, the lock assembly 800 operates in the same manner as the lock assembly 10.

Figure 22:
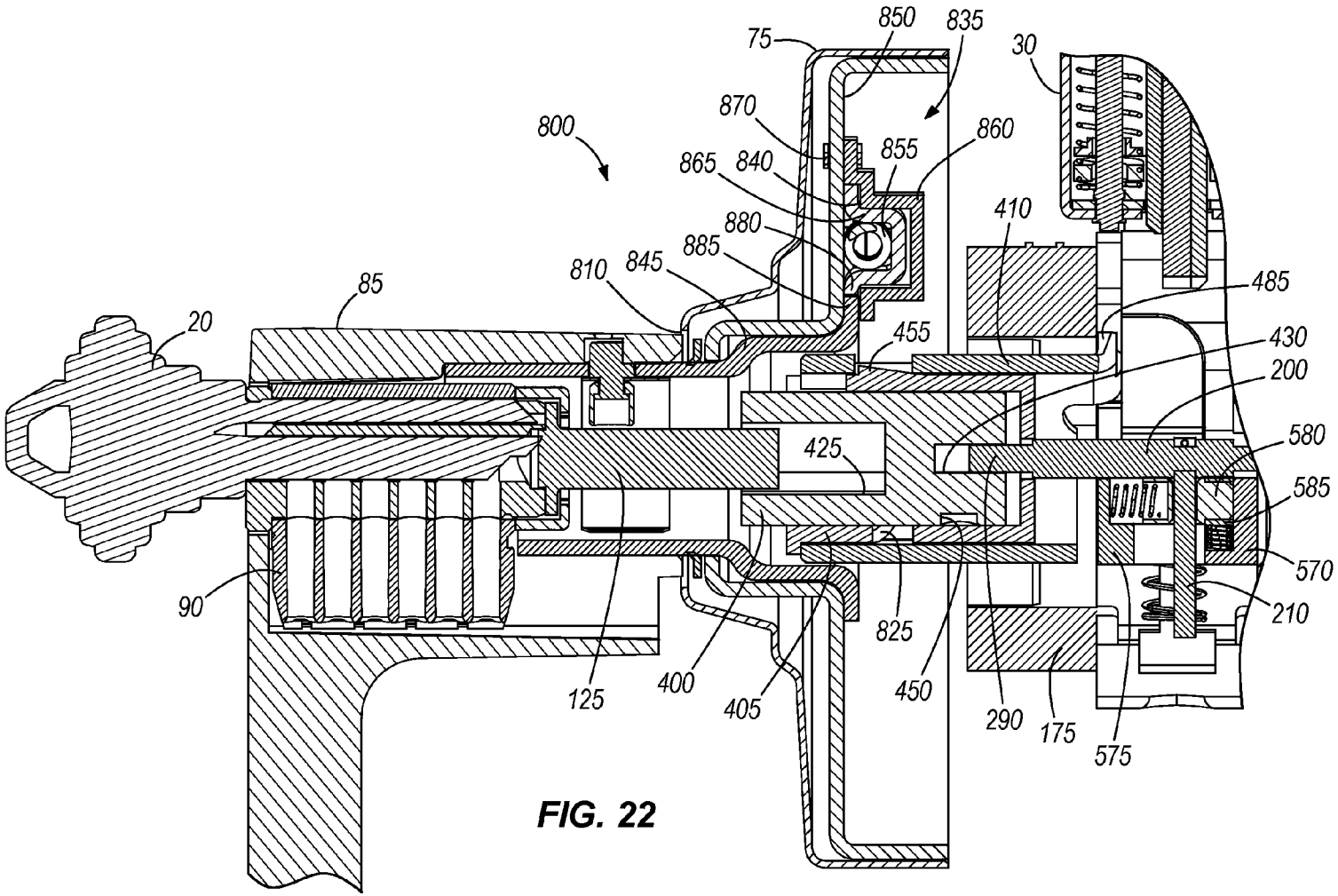
FIG. 22 is a section view of the lock assembly of FIG. 20 taken along line 22-22.

FIGS. 21 and 22 show the lock assembly 800 in the unlocked state and the interior and exterior handles 85, 140 in the non-rotated state. In the unlocked, non-rotated orientation, the latch 60 extends into the strike plate, and the pushbutton 190 and the pushbutton bar 200 are biased toward the interior handle assembly 40. Because the exterior and interior handles 85, 140 are in the non-rotated state, the interior and exterior retractors 570, 575 are biased away from the central portion 535 of the retainer apparatus 525. The protrusion 435 of the driver 400 is disposed in the helical slot 825 adjacent the second end 525. The tailpiece 125 is engaged with the driver 400 within the first recess 425, and the pushbutton bar 200 is engaged with the driver 400 within the second recess 430. The interior and exterior retractors 570, 575 move toward the central portion 535 in response to rotation of either the exterior handle 85 or the interior handle 140 to move the latch 60 to the retracted state.

Figure 24:
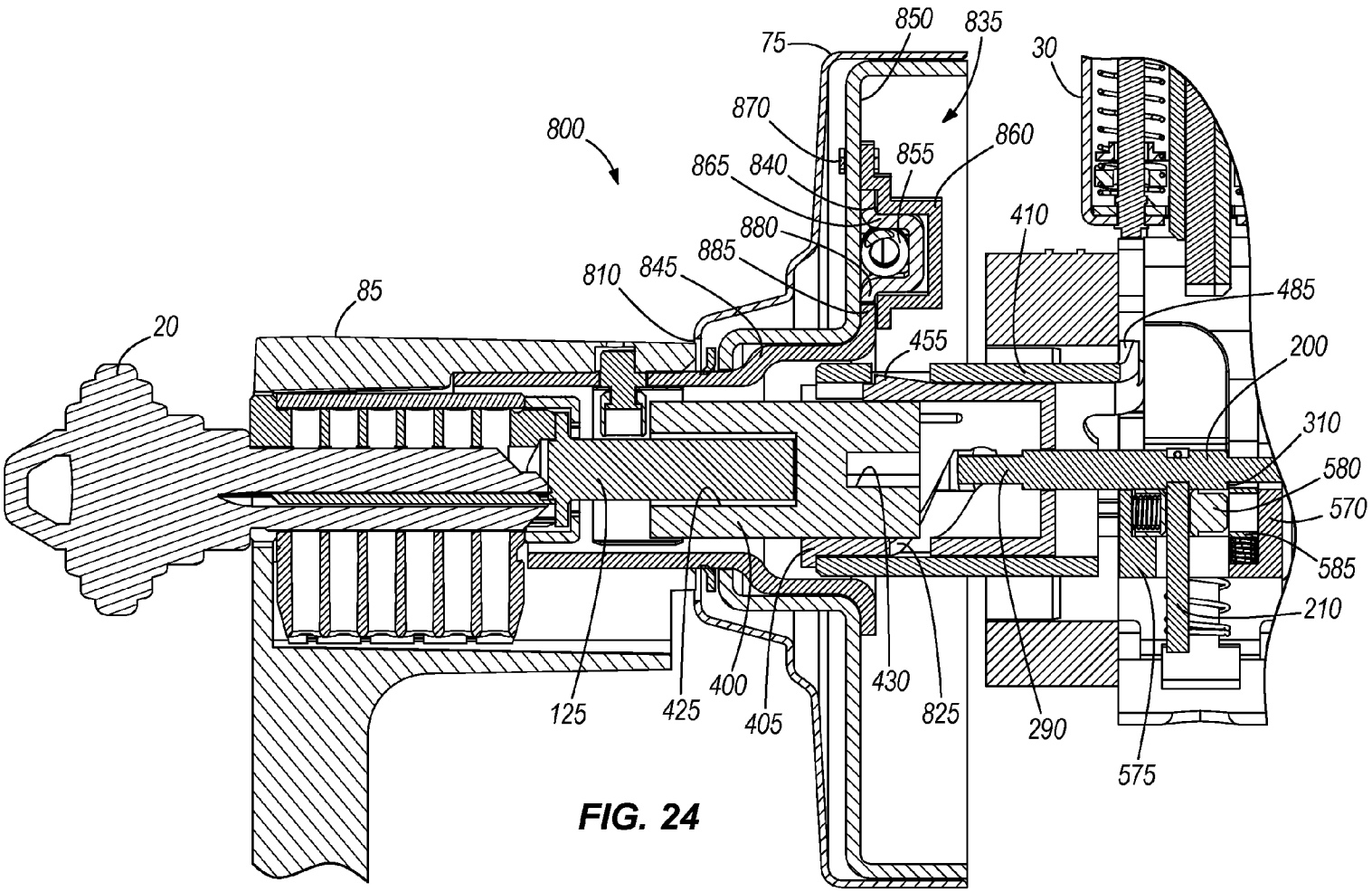
FIG. 24 is a section view of the lock assembly taken along line 24-24 of FIG. 23.

FIGS. 23 and 24 show the lock assembly 800 in a locked, free spinning state. The lock assembly 800 is varied to the locked state as described with regard to FIGS. 1-20 using the pushbutton assembly 160, or alternatively, the push and turn button assembly 720. As illustrated in FIGS. 23 and 24, the lock assembly 800 is further adjusted to the free spinning state by inserting an appropriate key 20 into the plug 120. Upon rotation of the key 20, the protrusion 435 moves or is pulled within the helical slot 825 and the driver 400 is moved outward toward the exterior handle assembly 35 relative to the exterior driver catch 405. The tailpiece 125 remains engaged with the driver 400 within the first recess 425, and the pushbutton bar 200 is disengaged from the driver 400 due to the rotation and translation caused by movement of the protrusion 435 within the helical slot 825.

To vary the lock assembly 800 to the locked, non-free spinning state, the appropriate key 20 is again used to rotate the plug 120, this time in the direction opposite the rotational direction used to achieve the free spinning state. Upon rotation of the key 20, the protrusion 435 moves or is pushed within the helical slot 825 via rotation of the tailpiece 125 such that the driver 400 is further recessed in the exterior driver catch 405. The tailpiece 125 remains engaged with the driver 400 within the first recess 425, and the pushbutton bar 200 is re-engaged with the driver 400 due to the rotation and translation caused by movement of the protrusion 435 within the helical slot 825.

As shown in FIGS. 25 and 26, the handle alignment mechanism 835 and the inter-engagement of the exterior spindle 410 with the exterior retractor 575 cooperate to define the locked, free spinning state of the lock assembly 800. FIG. 25 illustrates the lock assembly 800 before the exterior handle 85 is rotated. FIG. 26 illustrates the exterior handle 85 being rotated in the free spinning state. With reference to FIGS. 25 and 26, the pinion mechanism 845 rotates with the exterior handle 85, and via engagement of the pinion teeth 885 with the rack teeth 880, the rack 865 is moved laterally along the interior surface 850 of the first trim piece 75 in response to this rotation. At the same time, the exterior handle 85 rotates the exterior spindle 410, which moves the exterior refractor 575 independent from the interior refractor 570 as described with regard to FIGS. 1-20.

With continued rotation of the exterior handle 85, the exterior retractor 575 moves toward and eventually substantially abuts the central portion 535 of the retainer apparatus 525. At this point, the rack 865 has reached the farthest lateral position attainable. Further rotation of the exterior handle 85 does not further move the exterior retractor 575 or the rack 865. Instead, further rotation of the exterior handle 85 causes the pinion teeth 885 to rotate beyond the rack teeth 880 such that the adjacent free spinning portion 890 rotatably slides or "slips" along the last rack tooth 880. As shown in FIG. 26, the free spinning portion 890 is engaged with the rack 865 after the exterior handle 85 rotates at least 45 degrees. Other angles (e.g., at least 30 degrees, 60 degrees, 90 degrees, etc.) at which the rack 865 can be engaged by the free spinning portion 890 are also possible and considered herein.

The bias member 855 holds the rack 865 in engagement with the pinion mechanism 845, while lateral movement of the rack 865 and the rotational movement of the pinion mechanism 845 hold the rack 865 at the farthest lateral position until the pinion teeth 885 re-engage the rack teeth 880 in response to rotation of the exterior handle 85 back toward the non-rotated state.

At substantially the same time that the free spinning portion 890 begins to slip along the rack 865, the exterior refractor 575 engagement portion 560 closest to the exterior retractor 575 is no longer drivingly engaged with the exterior retractor 575. At this point, the second flange 475 slides or "slips" along the second ledge 665 because the exterior retractor 575 engagement portion 560 no longer exerts a force that can move the exterior retractor 575.

As shown in FIGS. 25 and 26, the bias member 855 biases the rack 865 toward a centered position located substantially within the rack guide 860. After the rack 865 reaches the farthest lateral position and the exterior handle 85 begins to slip, the user would not likely continue to rotate the exterior handle 85. When the handle 85 is rotated back to the non-rotated state, either directly or indirectly by the user (e.g., directly—when the user realizes rotation of the handle 85 will not move the latch 60 to the retracted position, or indirectly—when the user releases the handle 85 entirely), the pinion teeth 885 eventually re-engage the rack teeth 880 to move the rack 865 to the centered position within the rack guide 860. At the same time, the exterior spindle 410 rotates in a reverse direction along the second ledge 665 until the second flange 475 is no longer engaged with the exterior retractor 575. At this point, the exterior retractor 575 has moved back across the maximum travel distance such that the exterior retractor 575 is nested in the interior retractor 570. The handle alignment mechanism 835 maintains alignment of the exterior handle 85 relative to the clutch mechanism 185 and other components of the lock assembly 10 by re-engaging the rack 865 with the pinion mechanism 845 due to the bias of the bias member 855 and rotation of the exterior handle 85 back toward the non-rotated state. In this manner, the rack teeth 880 re-mesh with the corresponding pinion teeth 885.

Even if the exterior handle 85 is rotated further away from the non-rotated state, the exterior handle 85 and the exterior spindle 410 will continue to slip adjacent the last rack tooth 880 and the second ledge 665, respectively. Also, the exterior handle 85 and the handle alignment mechanism 835 are designed to move bi-directionally such that the lock assembly 800 can reach the free spinning state in response to rotation of the handle 85 clockwise or counter-clockwise.

The chassis assembly 45 and the chassis assembly 805 including either the pushbutton assembly 160 or the push and turn button assembly 720 separately provide a button-actuated lock assembly 10, 800 that allows a user to lock the lock assembly 10 without breakage of internal components (e.g., the chassis assembly) resulting from someone rotating the exterior handle 85 farther than intended (e.g., in an attempt to gain access through the door 15 without an appropriate key 20). In particular, the interior retractor 570 is selectively connected to the exterior retractor 575 via the pushbutton assembly 160 such that the exterior retractor 575 moves with or independent from the interior retractor 570. The locking lug 580 is engageable and disengageable relative to the pushbutton catch 580 in response to movement of the button assemblies 160, 720 such that the interior retractor 570 and the second retractor 575 are coupled to each other for conjoined movement when the lock assembly 10 is in the unlocked state, and that are decoupled relative to each other for disjoined movement when the lock assembly 10 is in the unlocked state. When the lock assembly 10, 800 is in the locked state, disconnecting the interior and exterior retractors 570, 575 allows the exterior refractor 575 to move the maximum travel distance without corresponding movement of the interior retractor 570. In this manner, the internal components of the lock assembly 10, 800 are protected from damage without having to unlock the lock assembly 10, 800.

Because the interior retractor 570 is permanently coupled to the latch assembly 30, the door 15 can always be opened using the interior handle assembly 40. The door 15 can be selectively opened using the exterior handle assembly 35 when the lock assembly 10, 800 is in the unlocked state due to the indirect attachment of the exterior retractor 575 to the latch assembly 30. The pushbutton bar 200 further provides a mechanism that allows a user to vary the interior retractor 570 and the exterior retractor 575 to facilitate independent and dependent relative movement.

As can be appreciated, the free spinning mechanism of the lock assembly 800 defined by the exterior handle 85, the clutch mechanism 185, the exterior spindle 410, and the handle alignment mechanism 835 allow the exterior handle 85 to rotate without moving the latch 60 to the retracted state and without damaging internal components of the lock assembly 800. By disengaging the driver 400 from the pushbutton bar 200, the exterior handle 85 and the exterior spindle 410 can rotate freely relative to other components of the lock assembly 800, minimizing any damage that would otherwise occur to the lock assembly 800. With or without the free spinning mechanism, the selective relative movement of the interior and exterior retractors 570, 575 also limits potential damage to internal components that may otherwise occur due to unauthorized attempts to open the door 15.

Various features and advantages of the invention are set forth in the following claims.

What is claimed is:

1. A lock assembly having a locked state and an unlocked state, the lock assembly comprising:

a latch assembly having a latch movable between an extended position and a retracted position;

an interior handle assembly including an interior handle;

an exterior handle assembly opposite the interior handle assembly and including an exterior handle; and a clutch mechanism including a first retractor movable in response to movement of the interior handle and selectively in response to movement of the exterior handle, the first retractor always engaged with the latch assembly to move the latch between the extended position and the retracted position, and a second retractor engageable with and disengageable from the first retractor, the second retractor engaged with the first retractor and movable in response to movement of the exterior handle to move the latch between the extended position and the retracted position via the first retractor when the lock assembly is in the unlocked state, the second retractor disengaged from and movable relative to the first retractor such that movement of the second retractor does not move the latch when the lock assembly is in the locked state.

2. The lock assembly of claim 1, wherein the first retractor is directly coupled to the latch, and wherein the second retractor is nested in the first retractor.

3. The lock assembly of claim 1, wherein each of the first retractor and the second retractor is movable in response to movement of the interior handle, and wherein the first retractor is selectively movable in response to movement of the exterior handle.

4. The lock assembly of claim 3, wherein the first retractor is movable in response to movement of the exterior handle when the lock assembly is in the unlocked state, and wherein the first retractor is not movable in response to movement of the exterior handle when the lock assembly is in the locked state.

5. The lock assembly of claim 1, further comprising an engagement mechanism coupled to the interior handle assembly and engaged with the clutch mechanism, wherein the engagement mechanism includes a button accessible from adjacent the interior handle, an elongated bar engaged with the clutch mechanism, and an actuator coupled to the elongated bar and movable in response to movement of the button to couple and decouple the second retractor relative to the first retractor.

6. The lock assembly of claim 5, wherein the first retractor includes a catch and the second retractor includes a lock element selectively engageable with the catch such that the first retractor and the second retractor are coupled relative to each other for conjoined movement when the lock assembly is in the unlocked state, and decoupled relative to each other for disjoined movement when the lock assembly is in the unlocked state.

7. The lock assembly of claim 6, wherein the actuator is engaged with the lock element to couple and decouple the second retractor relative to the first retractor, and wherein the second retractor is decoupled from the first retractor via the lock element when the lock assembly is in the locked state.

8. A lock assembly having a locked state and an unlocked state, the lock assembly comprising:

a latch assembly having a latch movable between an extended position and a retracted position;

an interior handle assembly including an interior handle;

an exterior handle assembly opposite the interior handle assembly and including an exterior handle;

a clutch mechanism including a retractor mechanism coupled to the latch assembly to move the latch between the extended position and the retracted position, the retractor mechanism including a first retractor coupled to the latch and a second retractor engageable with and disengageable from the first retractor, the second retractor selectively movable relative to the first retractor in response to movement of the exterior handle; and an engagement mechanism coupled to the interior handle assembly and the exterior handle assembly, the engagement mechanism further coupled to the retractor mechanism and selectively operable to engage and disengage the second retractor relative to the first retractor, the engagement mechanism partially defined by an actuator assembly movable in a first direction to disengage the second retractor relative to the first retractor such that rotation of the exterior handle does not move the latch to the retracted state, the actuator assembly movable in a second direction to engage the second retractor relative to the first retractor such that rotation of the exterior handle is operable to move the latch to the retracted state.

9. The lock assembly of claim 8, wherein the first retractor is directly coupled to the latch assembly, the first retractor always movable in response to movement of the interior handle assembly and the exterior handle assembly, and wherein the second retractor is coupled to the first retractor and indirectly coupled to the latch assembly via the first retractor to move the latch between the extended position and the retracted position in response to movement of the interior handle assembly, and selectively in response to movement of the exterior handle assembly.

10. The lock assembly of claim 9, wherein the clutch mechanism includes a lock element disposed in the second retractor and a catch disposed in the first retractor and engageable by the lock element to couple the second retractor to the first retractor, and wherein the actuator assembly includes an elongated bar and an actuator coupled to the elongated bar and engaged with the lock element to disengage the second retractor from the first retractor in response to movement of the actuator assembly in the first direction.

11. The lock assembly of claim 10, wherein the actuator assembly further includes a cam member engageable with the catch to engage the second retractor with the first retractor in response to movement of the actuator assembly in the second direction.

12. The lock assembly of claim 11, wherein the exterior handle assembly includes a lock cylinder that has a housing and a plug, and wherein the elongated bar is rotatable in response to rotation of the plug to engage the second retractor with the first retractor.

13. The lock assembly of claim 11, wherein the lock assembly is in the locked state when the second retractor is disengaged from the first retractor, and wherein the lock assembly is in the unlocked state when the second retractor is engaged with the first retractor.

14. The lock assembly of claim 8, wherein at least a portion of the actuator assembly is movable linearly in the first direction to disengage the second retractor from the first retractor, and wherein at least a portion of the actuator assembly is rotatable in the second direction to engage the second retractor with the first retractor.

15. A lock assembly having a locked state and an unlocked state, the lock assembly comprising:

a latch assembly having a latch movable between an extended position and a retracted position;

an interior handle assembly coupled to the latch assembly and including an interior handle;

an exterior handle assembly opposite the interior handle assembly and including an exterior handle;

a clutch mechanism engaged with the latch to move the latch between the extended position and the retracted position; and a free spinning mechanism engageable with the clutch mechanism and partially defined by an alignment mechanism coupled to the exterior handle to maintain alignment of the exterior handle relative to other components of the lock assembly during rotation of the exterior handle, wherein in response to rotation of the exterior handle when the lock assembly is in the unlocked state, the clutch mechanism is operable by the exterior handle to move the latch from the extended position to the retracted position, and wherein in response to rotation of the exterior handle when the lock assembly is in the locked state, the latch remains in the extended position and the exterior handle is free to rotate 360 degrees.

16. The lock assembly of claim 15, wherein the clutch mechanism includes a spindle coupled to the exterior handle for rotation therewith, and wherein the spindle is engaged with the clutch mechanism in response to rotation of the exterior handle such that the spindle and the second retractor define a slip engagement when the exterior handle is rotated and the lock assembly is in the locked state.

17. The lock assembly of claim 15, wherein the alignment mechanism includes a rack and a pinion meshed with the rack, wherein the exterior handle assembly includes a trim piece, and wherein one of the rack and the pinion is coupled to the trim piece and the other of the rack and the pinion is coupled to the exterior handle.

18. The lock assembly of claim 17, wherein the clutch mechanism includes a first retractor directly coupled to the latch and movable in response to movement of the interior handle and the exterior handle, and a second retractor removably coupled and selectively movable relative to the first retractor in response to movement of the interior handle and the exterior handle.

19. The lock assembly of claim 17, wherein the pinion is partially defined by a free spinning portion that is engageable with the rack in response to rotation of the exterior handle when the lock assembly is in the locked state.

20. The lock assembly of claim 15, further comprising an engagement mechanism coupled to the interior handle assembly and the clutch mechanism, wherein the engagement mechanism is partially defined by an actuator assembly movable in a first direction to disengage the second retractor relative to the latch such that rotation of the exterior handle does not move the latch to the retracted state, and wherein the actuator assembly is movable in a second direction to engage the second retractor relative to the latch such that rotation of the exterior handle is operable to move the latch to the retracted state.

21. The lock assembly of claim 20, wherein the clutch mechanism further includes a lock element disposed in the second retractor and a catch disposed in the first retractor and engageable by the lock element to couple the second retractor to the first retractor, and wherein the lock element is engaged with the catch when the lock assembly is in the unlocked state, and wherein the lock element is disengaged from the catch when the lock assembly is in the locked state.

22. The lock assembly of claim 21, wherein the actuator assembly further includes an elongated bar and an actuator engaged with the lock element, wherein the lock element is disengaged from the catch in response to linear movement of the elongated bar and the actuator in the first direction, and wherein the lock element is engaged with the catch in response to rotation of the elongated bar in the second direction.

23. A lock assembly having a locked state and an unlocked state, the lock assembly comprising:

a latch assembly having a latch movable between an extended position and a retracted position;

an interior handle assembly coupled to the latch assembly and including an interior handle;

an exterior handle assembly opposite the interior handle assembly and including an exterior handle;

a clutch mechanism including a first retractor engaged with the latch to move the latch between the extended position and the retracted position, and a second retractor removably coupled to the first retractor such that the second retractor is selectively engaged with the latch; and a free spinning mechanism coupled to the exterior handle and engageable with the clutch mechanism such that in response to rotation of the exterior handle when the lock assembly is in the unlocked state, the clutch mechanism is operable by the exterior handle to move the latch from the extended position to the retracted position, and in response to rotation of the exterior handle when the lock assembly is in the locked state, the latch remains in the extended position and the exterior handle is free to rotate 360 degrees.

24. The lock assembly of claim 23, wherein the first retractor is always engaged with the latch and movable in response to movement of the interior handle assembly and the exterior handle assembly in the locked state and the unlocked state, and wherein the second retractor is movable independent of the first retractor in response to rotation of the exterior handle in the locked state.

25. The lock assembly of claim 23, wherein the clutch mechanism further includes a spindle coupled to the exterior handle for rotation therewith, and wherein the spindle is engaged with the second retractor in response to rotation of the exterior handle such that the spindle and the second retractor define a slip engagement when the exterior handle is rotated in the locked state.

26. The lock assembly of claim 23, wherein the free spinning mechanism is defined by an alignment mechanism that is coupled to the exterior handle to maintain alignment of the exterior handle relative to other components of the lock assembly during rotation of the exterior handle.

27. The lock assembly of claim 26, wherein the alignment mechanism includes a rack and a pinion meshed with the rack, and wherein the pinion is partially defined by a free spinning portion that is engageable with the rack in response to rotation of the exterior handle when the lock assembly is in the locked state.

28. The lock assembly of claim 23, wherein the clutch mechanism further includes a lock element disposed in the second retractor and a catch disposed in the first retractor and engageable by the lock element to couple the second retractor to the first retractor, and wherein the lock element is engaged with the catch when the lock assembly is in the unlocked state, and wherein the lock element is disengaged from the catch when the lock assembly is in the locked state.

29. The lock assembly of claim 28, wherein the lock assembly further includes an elongated bar and an actuator engaged with the lock element, wherein the lock element is disengaged from the catch in response to linear movement of the elongated bar and the actuator in the first direction, and wherein the lock element is engaged with the catch in response to rotation of the elongated bar in the second direction.

* * * * *